US005845589A

United States Patent [19]

Pfister

[11] Patent Number: 5,845,589

[45] **Date of Patent: *Dec. 8, 1998**

[54] FOLDING TABLE LEG SYSTEM

[76] Inventor: Joel W. Pfister, 4967 Kensington Gate, Shorewood, Minn. 55331

[ * ] Notice: The term of this patent shall not extend beyond the expiration date of Pat. No. 5,673,633.

[21] Appl. No.: 852,138

[22] Filed: May 6, 1997

Related U.S. Application Data

[63] Continuation of Ser. No. 455,496, May 31, 1995, Pat. No. 5,673,633.

[51] Int. Cl.[6] ..... A47B 3/00

[52] U.S. Cl. ..... 108/132; 108/133

[58] Field of Search ..... 108/115, 129, 108/132, 133; 248/188, 188.6, 439

[56] References Cited

U.S. PATENT DOCUMENTS 4,838,181 6/1989 Luyk ..... 312/131

FOREIGN PATENT DOCUMENTS 176955 4/1986 European Pat. Off. ..... 108/115

446642 3/1968 Switzerland ..... 108/115

*Primary Examiner*—Peter M. Cuomo

*Assistant Examiner*—Gerald A. Anderson

*Attorney, Agent, or Firm*—Hugh D. Jaeger

[57] ABSTRACT

Folding table leg system for positive locking of a table leg in a down and locked position or for positive locking of a table leg in an up and locked position, where a spring loaded lever operated pawl automatically engages an extruded rotatable block member to achieve either an uplocked or downlocked position. A secondary safety lock is also provided. An alternate embodiment provides for a folding table leg system having a minimum of structural components which features primary tangential and wedge locking and secondary locking for massive load or violent shock load occurrence.

4 Claims, 22 Drawing Sheets

FOLDING TABLE LEG SYSTEM

CROSS REFERENCES TO CO-PENDING APPLICATIONS

This patent application is a continuation-in-part (CIP) of application Ser. No. 08/455,496 filed May 31, 1995, now U.S. Pat. No. 5,673,633 entitled "Table Leg System" by the same inventors.

BACKGROUND OF THE INVENTION

1. Field of the Invention

The present invention is for a folding table leg system, and more particularly pertains to a lever operated locking base for a folding table leg.

2. Description of the Prior Art

Practical table legs, such as for training and classroom tables, tables found in hotels, schools, or other institutions, have always been a problem. The legs have been unstable and awkward. Side loading of the leg members could cause disengagement of an upright leg from its locked position causing the leg to fold, thus causing the table to collapse.

The present invention overcomes the problems of prior art table legs.

SUMMARY OF THE INVENTION

The general purpose of the present invention is a folding table leg system.

According to one embodiment of the present invention, there is provided a folding table leg system, including an extruded rotatable block member having an uplock groove and a downlock groove and a latch member pivotally secured between opposing support brackets. Spring members secured to the latch member bias the latch member for engagement with either a downlock or an uplock groove in the extruded rotatable block member. Actuating levers are secured to the latch member to overcome spring biased engagement of the latch member with the rotatable block member to allow rotation of the rotatable block member and an attached leg member to position the leg between a down and locked position and an up and locked position.

According to an alternate embodiment of the present invention, there is provided a locking base including an extruded rotatable block member having an uplock groove, a downlock groove, and a one-piece latch member secured between opposing support brackets. A one-piece cross member aligns and mutually secures the opposing support brackets for ease of fabrication. A spring loaded one-piece extruded latch member engages the extruded rotatable block member and includes a locking pawl which tangentially engages the downlock groove in the latch member.

One significant aspect and feature of the present invention is a folding table leg system in which a table leg can be positively locked in an extended or a stowed position. A latch member is held in engagement with an uplock or downlock groove in an extruded rotatable block member by spring force.

Another significant aspect and feature of the present invention is the utilization of actuation levers to simultaneously overcome spring force engagement and to operate a latch member. A latch member pawl having a wedge shape engages either an uplock or a downlock groove in a rotatable block member. The latch member pawl has opposing grooves along its tip which act as a secondary safety catch in conjunction with arced lip members of a downlock groove.

A further significant aspect and feature of the present invention is a folding table leg system which stows in a minimum profile position.

Another significant aspect and feature of the present invention is a folding table leg system which upon folding is horizontally compact to allow use on horizontally shortened tables.

Still another significant aspect and feature of the present invention is a locking base which is assembled in a simple fashion having support brackets which are mutually secured by a common cross member. The cross member includes angled members at opposing ends which slidingly engage slots in each support bracket.

Yet another significant aspect and feature of the present invention is a one-piece spring member.

Yet another significant aspect and feature of the present invention is a tangential locking arrangement which eliminates side or end load produced torsional or rotational load-induced lock disengagement.

Still another significant aspect and feature of the present invention is automatic engagement of the tangential locking arrangement in the downlock or uplock position.

Still other significant aspects and features of the present invention include a locking arrangement which provides for accommodation of levels of pawl or pawl-related member engagement for primary or secondary locking of a table leg system including static loads, massive end loads or violent shock loads. Static loads are accommodated by tangential/wedge locking pawl engagement, massive end loads are accommodated, as a safety measure, by grooves in a locking pawl which engage an arced lip in a downlock groove, and violent shock loads are accommodated by limitation of latch movement by the table's bottom surface whereby the locking pawl and leg movement is restricted.

Still another significant aspect and feature of the present invention is a folding table leg system having a locking base having a pivot point well displaced from a lower table top surface to which legs of different designs and styles can be readily and easily attached.

Having thus described embodiments of the present invention, it is the principal object of the present invention to provide a folding table leg system which can lock a leg in both the down and the up position.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
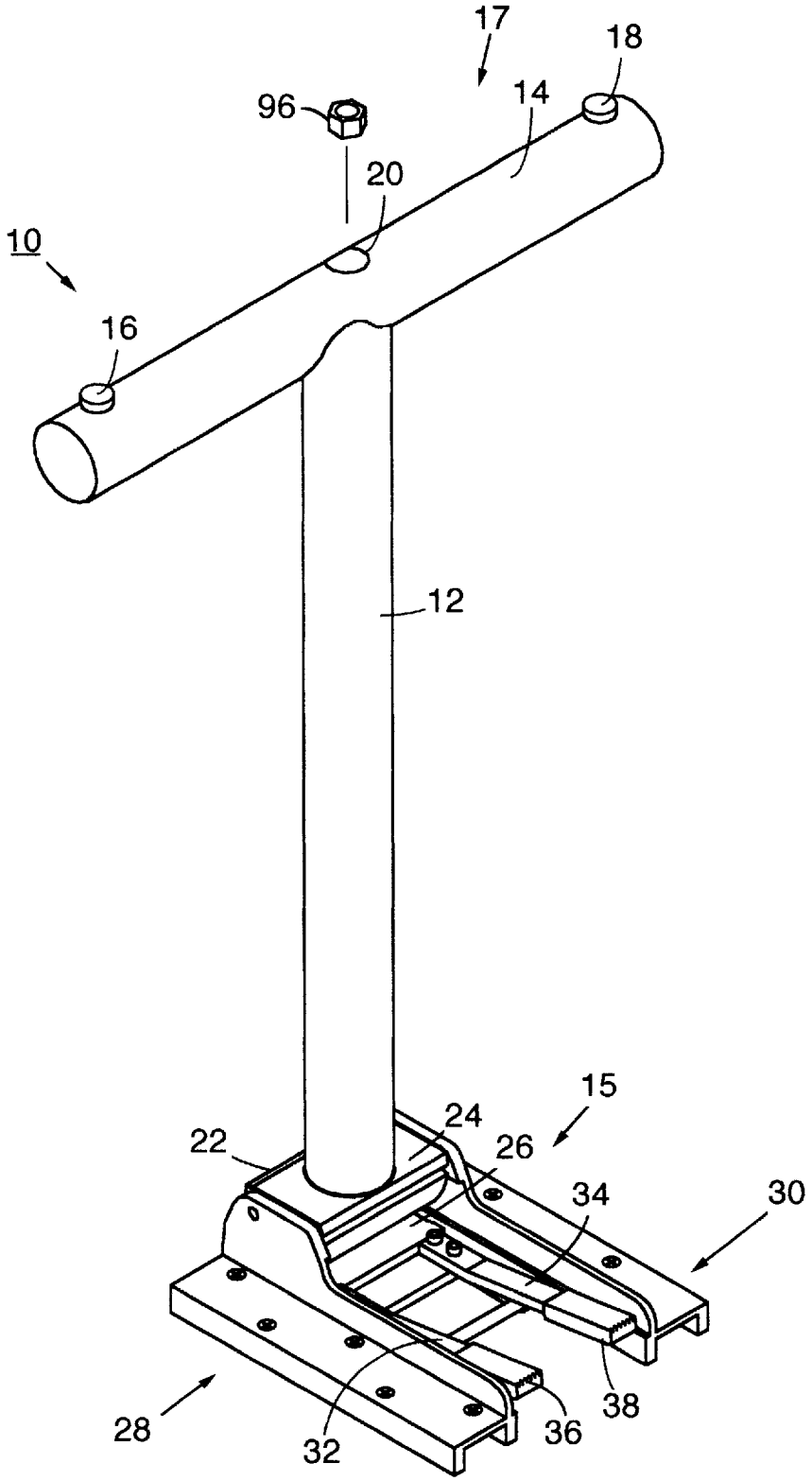
FIG. 1 illustrates an isometric view of a folding table leg system.

FIG. 1 illustrates an isometric view of a folding table leg system 10, the present invention, including a main support tube 12, a horizontal support tube 14 aligned and secured to the main support tube 12 at a right angle, and a locking base 15. The horizontal support tube 14 includes skids 16 and 18 of metal, rubber or plastic located at the ends of the horizontal support tube 14, and an access hole 20 in alignment with the longitudinal axis of the main support tube 12. The main support tube 12 and the horizontal support tube 14 form a table leg 17 which secures to and rotates about the locking base 15.

The locking base 15 includes an extruded rotatable block member 24 and a latch member 26 each pivotally supported between left and right angled mirror image-like support brackets 28 and 30. Angled actuating levers 32 and 34, having pliable plastic end caps 36 and 38, secure to the latch member 26. The latch member 26 is spring loaded to engage either an uplock or a downlock groove in the extruded rotatable block member 24, as later described in detail.

Figure 2:
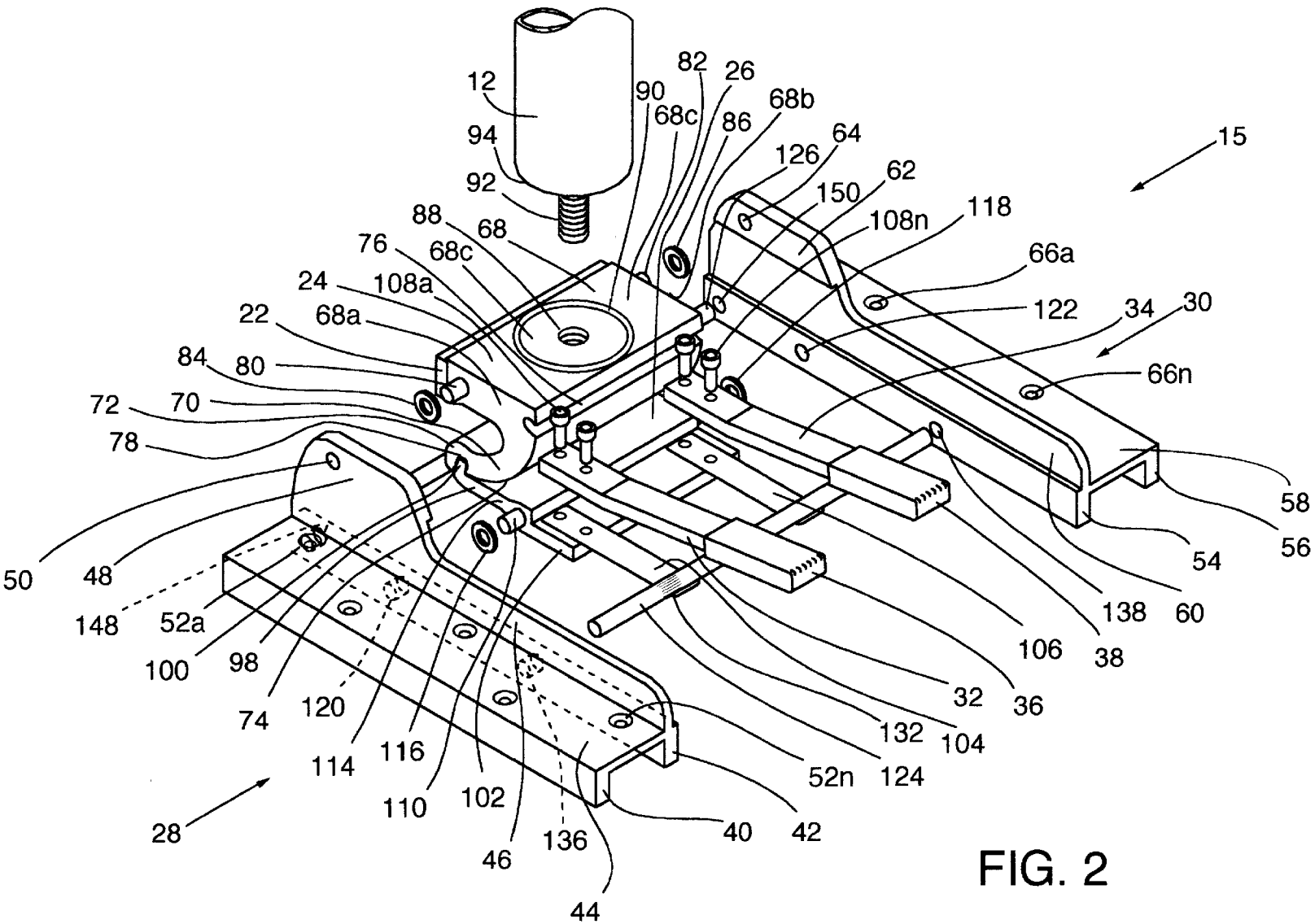
FIG. 2 illustrates an exploded isometric view of a locking base.

FIG. 2 illustrates an isometric exploded view of the locking base 15, where all numerals correspond to those elements previously described. The one-piece support bracket 28 includes vertical planar members 40 and 42, an interceding horizontal planar member 44 aligned between the vertical planar members 40 and 42, and a vertical planar member 46 extending vertically from the horizontal planar member 44. The vertical planar member 46 includes an upper reinforced thicker area 48 having a horizontally aligned pivot hole 50. A plurality of recessed anchoring holes 52*a*–52*n* along the horizontal planar member 44 allow for the mounting of the support bracket 28 to the undersurface of a table by the use of appropriate fasteners.

In a like manner, the one-piece support bracket 30 is constructed in a similar fashion to include vertical planar members 54 and 56, an interceding horizontal planar member 58 aligned between the vertical planar members 54 and 56, and a vertical planar member 60 extending vertically from the horizontal planar member 58. The vertical planar member 60 includes an upper reinforced thicker area 62 having a horizontally aligned pivot hole 64. A plurality of recessed anchoring holes 66*a*–66*n* along the horizontal planar member 58 allow for the mounting of the support bracket 30 to the underside of a table by the use of appropriate fasteners.

The rotatable block member 24 includes a substantially rectangular solid-like block member 68 having an interrupted arcuate member 70 descending from one edge of the substantially rectangular solid-like block member 68 to terminate in a smaller radiused end member 72. The arcuate member 70 includes an arcuate surface 74 interrupted near its top by a horizontally aligned downlock groove 78. The arcuate surface 74 is also interrupted near the smaller radiused end member 72 by a horizontally aligned uplock groove 76. Dowel pin pivots 80 and 82, being the centers for the arcuate surface 74 and for rotation of the rotatable block member 24, extend outwardly and horizontally from the sides 68*a* and 68*b* of the block member 68 to accommodate washers 84 and 86 and horizontally aligned pivot holes 50 and 64 in the upper reinforced thicker areas 48 and 62 of the support brackets 28 and 30, respectively. A threaded hole 88 and an annular groove 90 align through the planar surface 68*c* in the block member 68 to mountingly accommodate and serve as a securement base for the threaded rod 92 and for the tubular edge 94 of the main support tube 12, respectively. A nut 96, illustrated in FIG. 1, gains access to the interior of the horizontal support tube 14 and the main support tube 12. In the alternative, planar surface 68*c* and the solid-like block member 68 can be utilized to accommodate and/or fasten various styles or lengths of table legs as desired.

The latch member 26 is extruded as a one-piece member which resembles the mating of two planar members, one of which includes a pawl. One such planar member 98 includes a pawl 100 extending at an angle from the planar member 98 to automatically engage either the downlock groove 78, as illustrated, or to engage the uplock groove 76 subsequent to rotational movement of the rotatable block member 24. The other planar member 102 serves as a mount for spring members 104 and 106 and actuating levers 32 and 34 which are secured by a plurality of fasteners 108*a*–108*n* passing through the spring members 104 and 106 and actuating levers 32 and 34 to secure to the planar member 102. Dowel pin pivots 110 and 112, as also illustrated in FIG. 3, extend from the thick area 114 formed by the planar members 98 and 102 to fit and align within spacer washers 116 and 118 and holes 120 and 122 in the vertical planar members 42 and 54 of the support brackets 28 and 30, respectively.

Horizontally aligned pins 124 and 126, having fluted engagement surfaces, extend between and frictionally engage the support brackets 28 and 30 to capture the rotatable block member 24 and the latch member 26 and their associated members. With additional reference to FIG.

3, the ends of pin 124 are aligned in holes 128 and 130 in vertical planar members 40 and 56, and the fluted engagement surfaces 132 and 134 at the intermediate areas of the pin 124 frictionally engage holes 136 and 138 in vertical planar members 42 and 54. In a similar fashion, the ends of pin 126 are aligned in holes 140 and 142 in the opposing ends of vertical planar members 40 and 56, and the fluted engagement surfaces 144 and 146 at the intermediate areas of pin 126 frictionally engage holes 148 and 150 in the vertical planar members 42 and 54. Pin 124, in addition to serving as a structural tie member, also serves as a spring tension facilitator. Spring members 104 and 106 extend from the latch member 26 to a position beneath the pin 124 in a manner to cause upward rotational positioning of the pawl 100, as viewed in FIG. 2, about dowel pin pivots 110 and 112 into the downlock groove 78, or alternately of the pawl 100 into the uplock groove 76. Actuating levers 32 and 34 are angled upwardly, as viewed, to clear pin 124 and to allow the user finger insertion room between the ends of the actuating levers 32 and 34 and the lower table surface so that actuation may be accomplished. A protective rubber member 22 secures to one edge of the rotatable block member 24 for stacking of tables when the horizontal support tube 14 is in the up and locked position.

Figure 3:
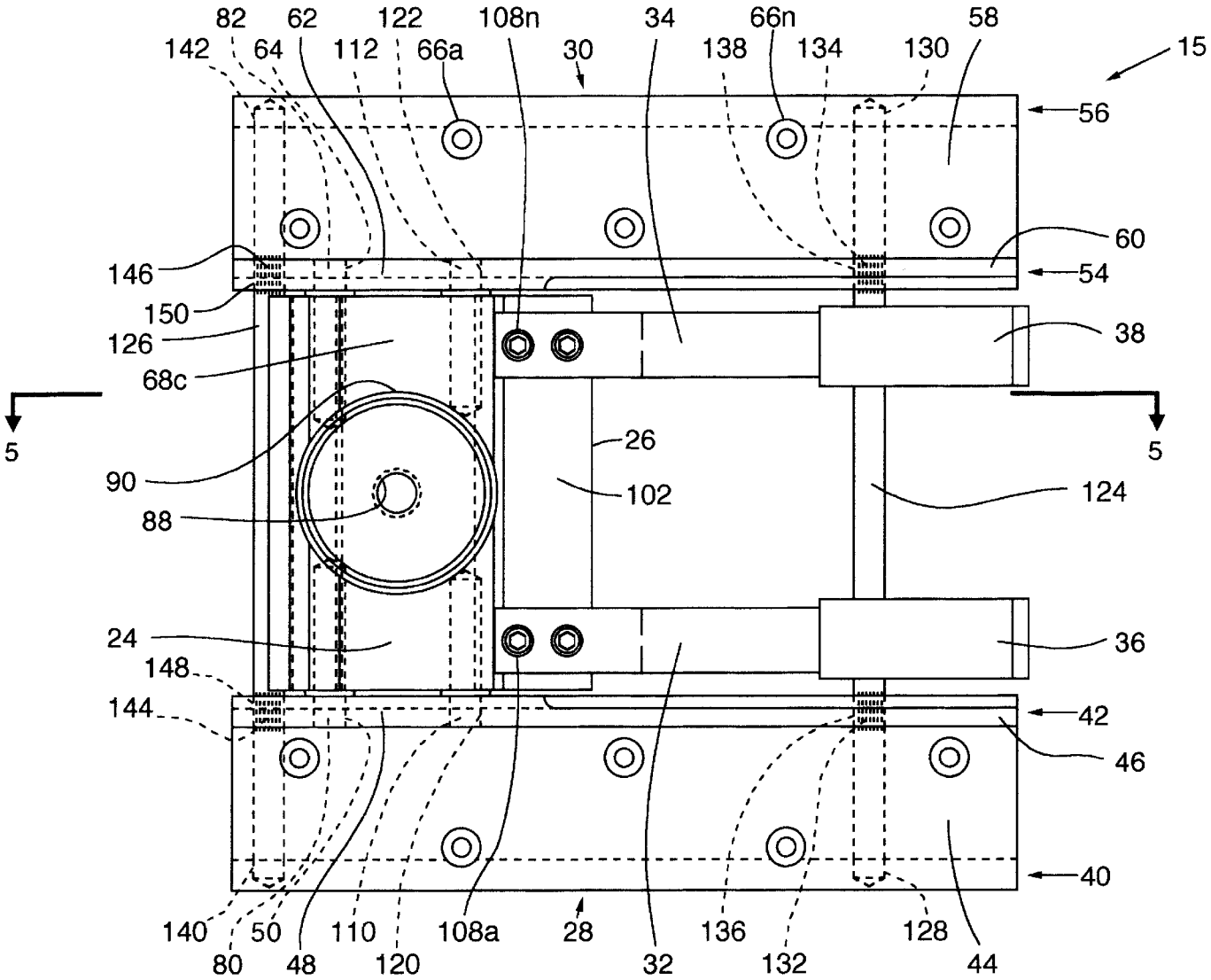
FIG. 3 illustrates a top view of the locking base.

FIG. 3 illustrates a top view of the locking base 15, where all numerals correspond to those elements previously described. Illustrated in particular are the horizontal pins 124 and 126 in frictional engagement with the support brackets 28 and 30 to cause capture of the rotatable block member 24 and latch member 26 therebetween. Rotatable block member 24 serves as a mount for one main support tube, such as support tube 12 of FIG. 3. It is appreciated that a lengthened rotatable block member, and of course, lengthened pins 124 and 126, as well as any other appropriate component members, can be utilized to provide for mounting of one or more support tubes across the breadth of a table top lower surface.

Figure 4:
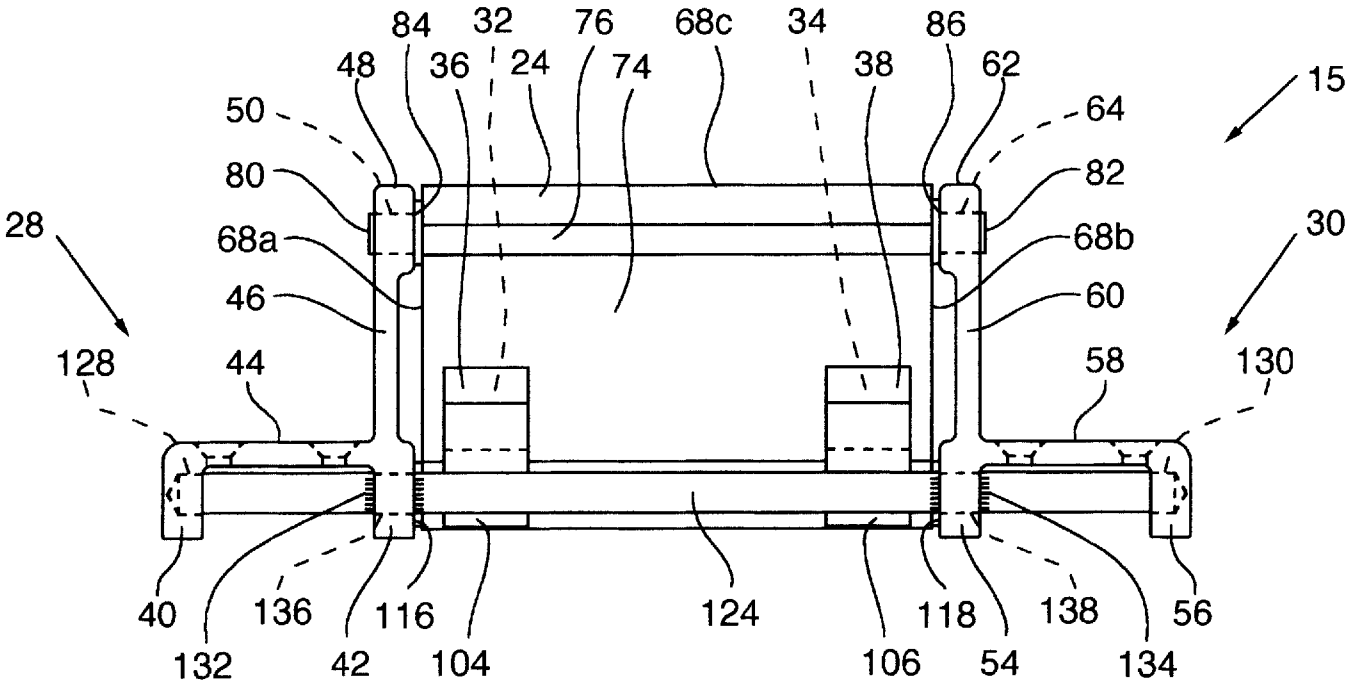
FIG. 4 illustrates a right end view of the locking base.

FIG. 4 illustrates a right end view of the locking base 15, where all numerals correspond to those elements previously described.

Figure 5:
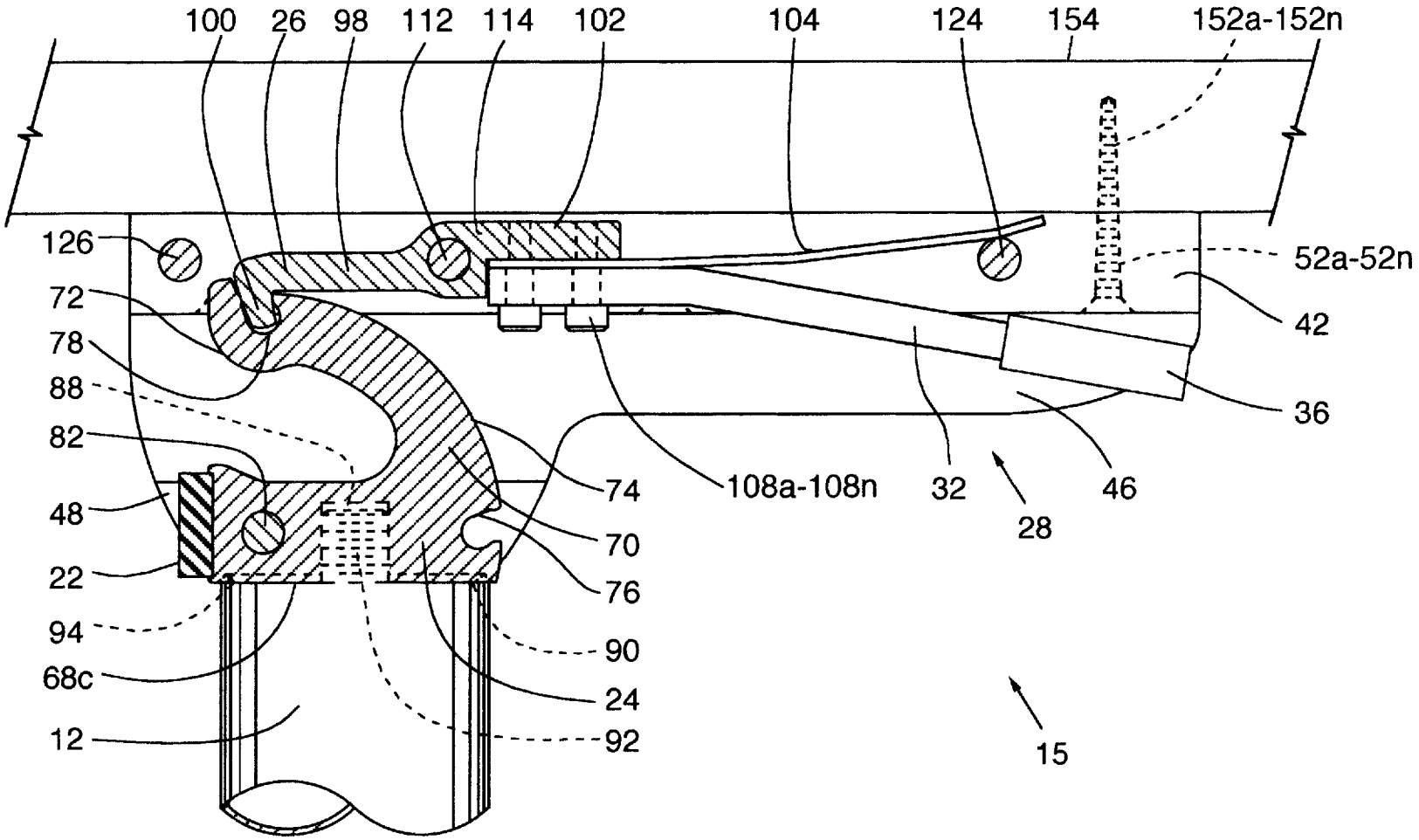
FIG. 5 illustrates an inverted cross sectional view along line 5—5 of FIG. 3 of the locking base with a main support tube in the down and locked position.
Figure 6:
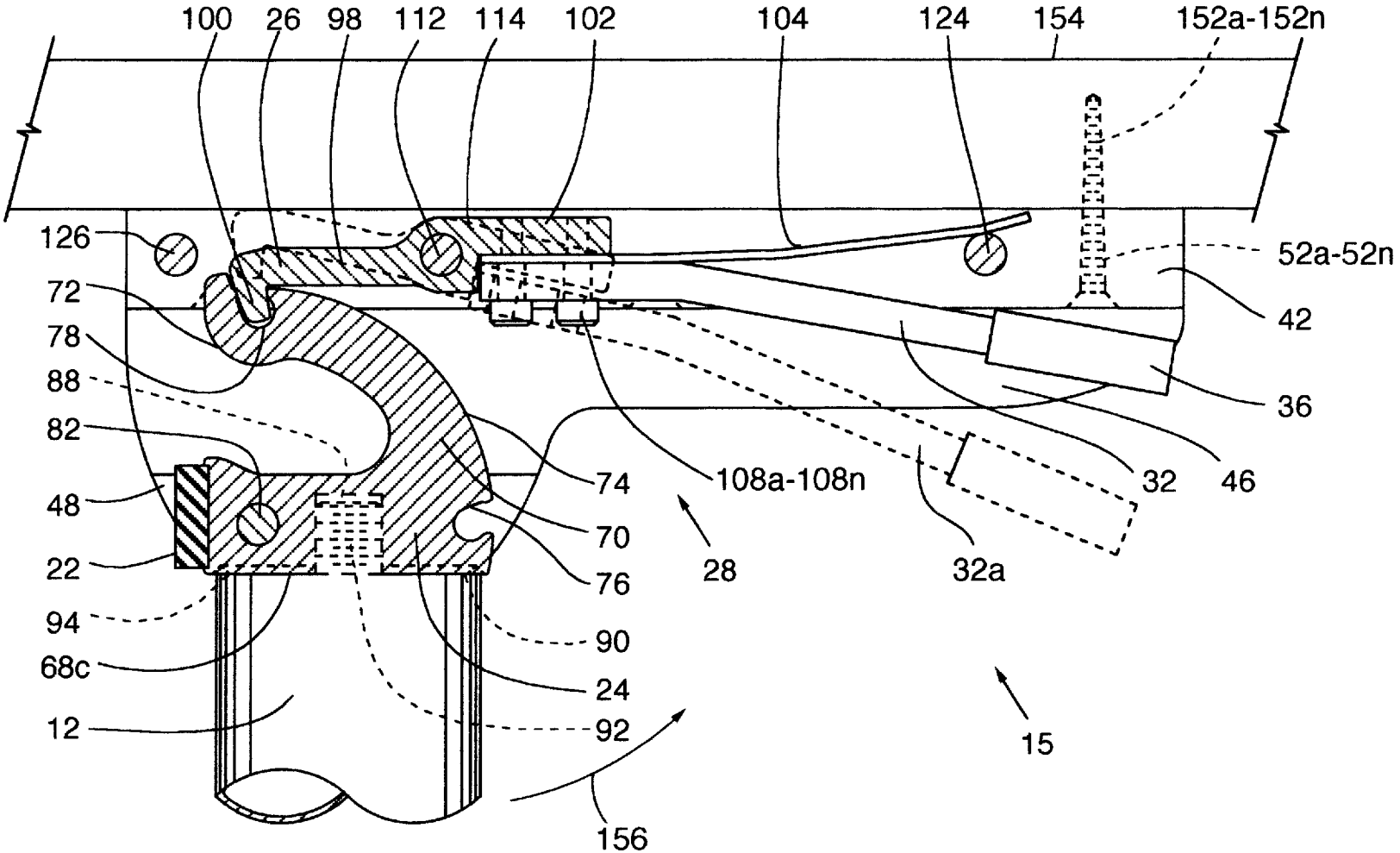
FIG. 6 illustrates the locking base of FIG. 5 and the disengagement of the pawl from the rotatable block member.
Figure 7:
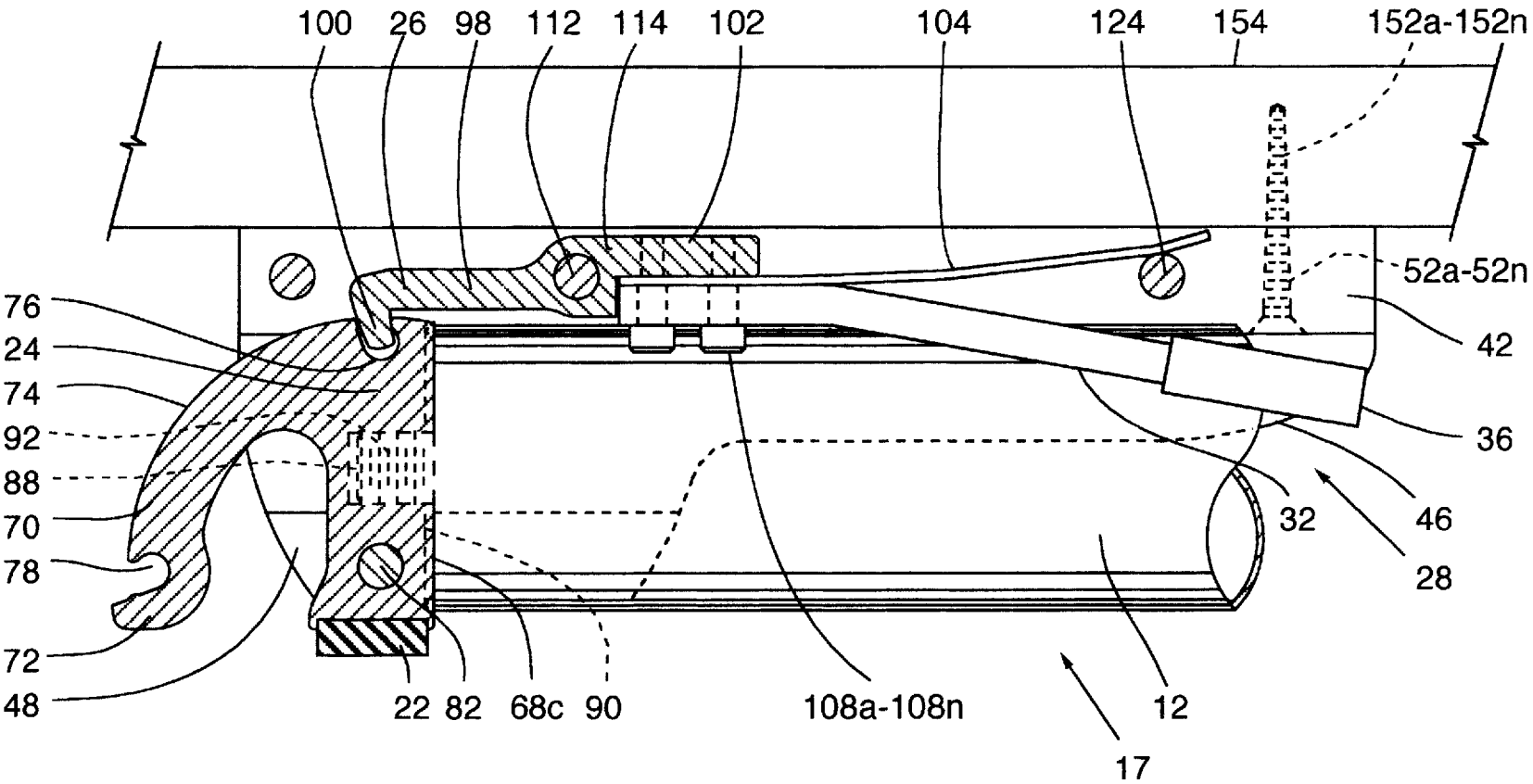
FIG. 7 illustrates the locking base of FIG. 5 with the main support tube in the up and locked position.

FIGS. 5, 6 and 7 best illustrate the mode of operation of the locking base 15.

FIG. 5 illustrates an inverted cross sectional view of the locking base 15 with the main support tube 12 in the down and locked position along line 5—5 of FIG. 3, where all numerals correspond to those elements previously described. The locking base 15 secures by fasteners 152*a*–152*n* through support brackets 28 and 30 to a planar table member 154. Pawl 100, having angled sides, is illustrated in wedge-like engagement with the downlock groove 78 in the rotatable block member 24 to maintain the rotatable block member 24, and thus the horizontal support tube 14 and the main support tube 12, in the down and locked position, as illustrated. The angled sides of the pawl 100 are driven by force of spring members 104 and 106 into wedge-like contact with two opposing surfaces of the downlock groove 78, as illustrated in detail in FIG. 8.

FIG. 6 illustrates the locking base 15 of FIG. 5 with the actuating lever 32 depressed to disengage the pawl 100 from the downlock groove 78 of the rotatable block member 24 so that the rotatable block member 24, main support tube 12, and attached horizontal support tube 14 can be pivoted about the dowel pin pivots 82 and 80. The actuated position of actuating lever 32 is illustrated in dashed lines and referenced as 32*a*. Actuation of either actuating lever 32 or actuating lever 34 causes the latch member 26 to rotate about the dowel pin pivots 112 and 110, thereby removing the pawl 100 from influence of the downlock groove 78. Upon release of the rotatable block member 24 from the latch member pawl 100, the main support tube 12 and the horizontal support tube 14, which form table leg 17, are swung as indicated by arrow 156 toward a position parallel to the planar table member 154 to automatically engage the uplock groove 76 at the opposing end of the arcuate surface 74. Spring pressure provided by spring members 104 and 106 causes the pawl 100 to slidingly traverse the arcuate surface 74 until spring forced engagement of the pawl 100 with the uplock groove 76 is effected, as illustrated in FIG. 7.

FIG. 7 illustrates the locking base 15 of FIG. 5 having the rotatable block member 24 in the up and locked position, where all numerals correspond to those elements previously described. As previously described, actuating levers 32 and 34 were previously depressed allowing disengagement of the pawl 100 from the downlock groove 78 to allow positioning of the table leg 17 parallel to the planar table member 154, as illustrated. Spring members 104 and 106 forcibly position the pawl 100 into wedge-like forced engagement with the uplock groove 76 to lock the table leg 17 in the folded and stowed position. The folded and stowed position of the table leg 17 provides for leg stowage in very close proximity to the undersurface of the table. This close-in leg stowage offers a very low profile which is highly desirable when stacking of tables incorporating the folding table leg system. Placement of the dowel pin pivots 80 and 82 at a distance from rather than closer to the table underside is of great significance with respect to obtaining a low profile leg stowage. If, for instance, a pivot point were placed at a point closer to the table undersurface or closer to the table center, stowage with a greater profile would be the likely outcome.

Figure 8:
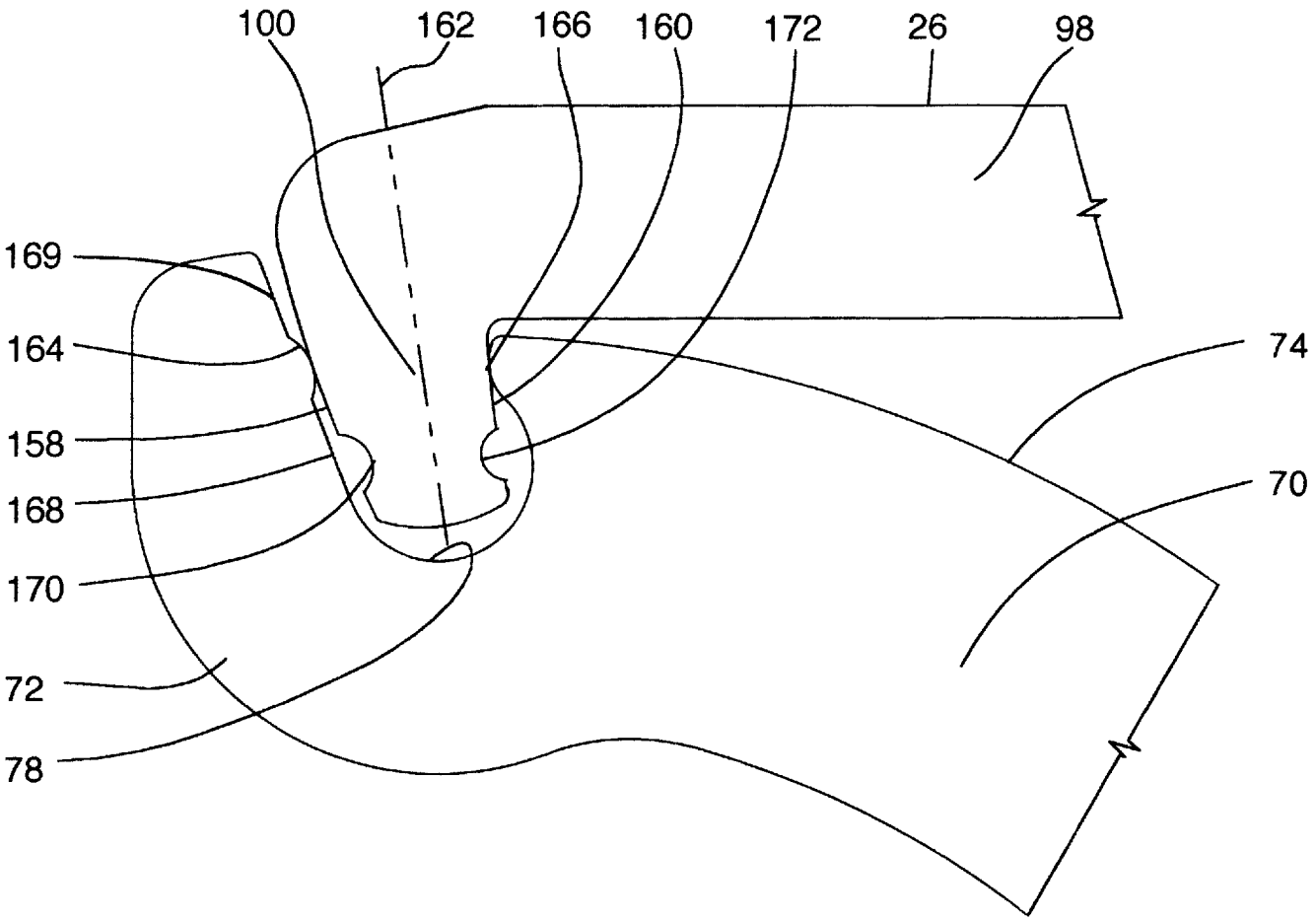
FIG. 8 illustrates the engagement of the pawl with the downlock groove.

FIG. 8 illustrates the engagement of the pawl 100 of the latch member 26 with the downlock groove 78 of the rotatable block member 24, where all numerals correspond to those elements previously described. The pawl 100 includes surfaces 158 and 160 which are angularly displaced approximately the same amount from the pawl center line 162 to form a wedge. The tension of the spring members 104 and 106 forces the tapered and angled surfaces 158 and 160 of the pawl 100 into wedge-like engagement with horizontally extending arced lips 164 and 166. Constant force wedge-like engagement of the pawl 100 into the downlock groove 78 provides for secured rigidity of the table leg 17, without looseness or sloppiness, with respect to the planar table member 154 illustrated in FIG. 10. Arced lip 166 is located at the junction of the arcuate surface 74 and the downlock groove 78. The other arced lip 164 is located in opposition to the arced lip 166 on the planar surface 168 of the downlock groove 78. Component wear is accounted for in the design of the pawl 100 and the downlock groove 78 and adjacent areas. Should wear occur where the arced lips 164 and 166 contact the angled pawl surfaces 158 and 160, spring tension is available to drive the wedge-like pawl 100 deeper into the downlock groove 78 to ensure plumb and well secured alignment of the main support tube 12.

Arced lips 164 and 166 also provide a secondary locking function in that if excess and/or massive torsional side or end loads about dowel pin pivots 80 and 82 of the rotatable block member 24 are introduced to the table leg 17, horizontally aligned groove 170 or 172 at the lower portions of pawl surfaces 158 and 160 will catch and engage arced lip 164 or 166, respectively, if the pawl 100 is forced upwardly and outwardly from the downlock groove 78 by displacement of the table leg 17 and corresponding displacement of the rotatable block member 24. This engagement prevents collapse of the table leg 17, thereby holding the table leg 17 upright in an uncollapsed position with only a slight deviation from plumb vertical alignment.

Figure 9:
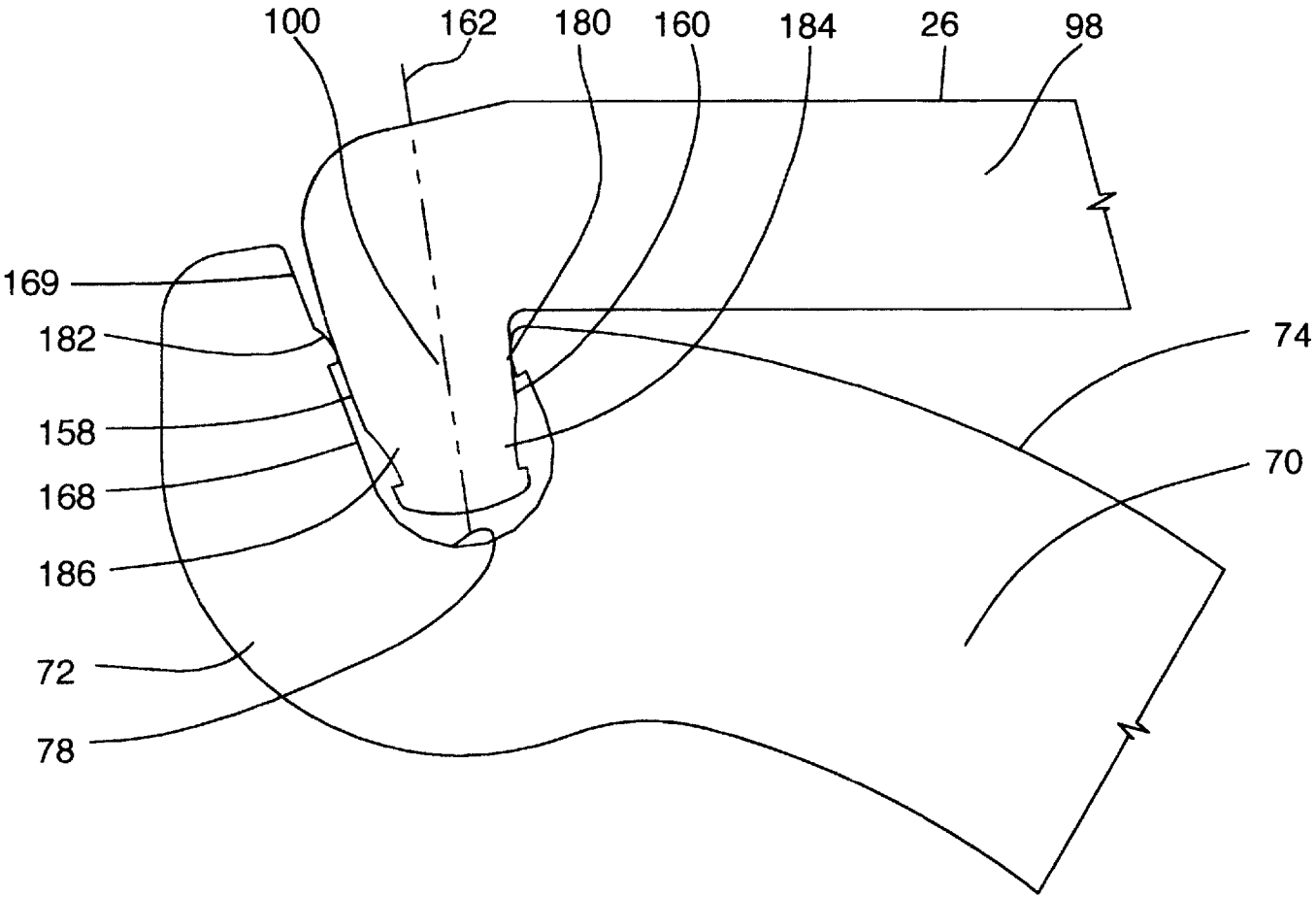
FIG. 9, an alternative embodiment, illustrates the engagement of the pawl with the downlock groove where hook and latch safety catches are utilized.

FIG. 9, an alternative embodiment, illustrates the engagement of a pawl 100 of the latch member 26 with the downlock groove 78 of the rotatable block member 24, where all numerals correspond to those elements previously described. In this illustration, hook and latch members have been incorporated in lieu of arced lips 164 and 166 and grooves 170 and 172 to effect a positive locking method should excessive and/or massive torsional leg side or end loads occur about dowel pin pivots 80 and 82 of the rotatable block member 24. As in FIG. 8, the pawl 100 includes surfaces 158 and 160 which are angularly displaced the same amount from the pawl center line 162 to form a wedge. The tension of the spring members 104 and 106 forces the tapered and angled surfaces 158 and 160 of the pawl 100 into wedge-like engagement with horizontally extending and protruding semi-circular profile hook members 180 and 182 which resemble a half portion of the arced lips 164 and 166 of FIG. 8. The semi-circular hook member 180 is located at the junction of the arcuate surface 74 and the downlock groove 78. The other semi-circular hook member 182 is located in opposition to the semi-circular hook member 180 on the planar surface 168 of the downlock groove 78. Component wear is accounted for in the design of the pawl 100 and the downlock groove 78 and adjacent areas. Should wear occur where the semi-circular hook members 182 and 180, respectively, contact the angled surfaces 158 and 160, spring tension is available to drive the wedge-like pawl 100 deeper into the downlock groove 78 to ensure plumb and well secured alignment of the main support tube 12. Semi-circular hook members 180 and 182 also provide a positive secondary locking function in that if excessive and/or massive torsional side or end loads about dowel pin pivots 80 and 82 of the rotatable block member 24 are introduced to the table leg 17, horizontally aligned semi-circular latch members 184 and 186 at the lower portions of pawl surface 160 or 158 will catch and engage the semi-circular hook member 180 or 182, respectively, if the pawl 100 is forced upwardly and outwardly from the downlock groove 78 by displacement of the table leg 17 and corresponding displacement of the rotatable block member 24. This positive hook- and latch-like engagement prevents collapse of the table leg 17, thereby holding the table leg 17 upright in an uncollapsed position with only a slight deviation from plumb vertical alignment.

Figure 10:
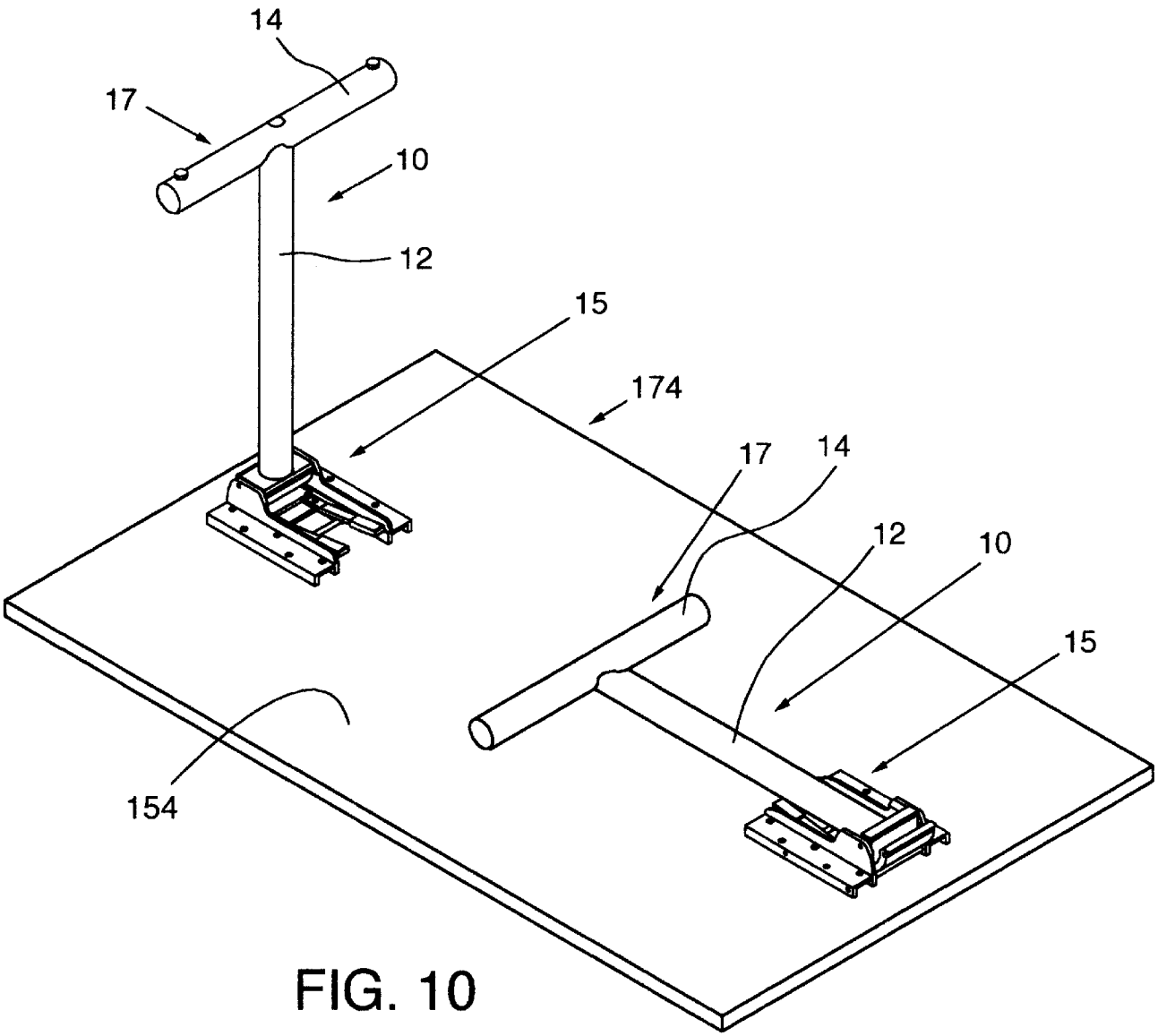
FIG. 10 illustrates table legs secured in the up and locked and in the down and locked positions on a table surface.

FIG. 10 illustrates a table leg 17 secured to the lower planar surface of planar table member 154 of a table top 174 and erected and locked into an extended position by the locking base 15. Also illustrated is a table leg 17 folded over into a stowed position parallel to the lower planar surface of planar table member 154 and locked into the parallel position by the locking base 15.

Figure 11:
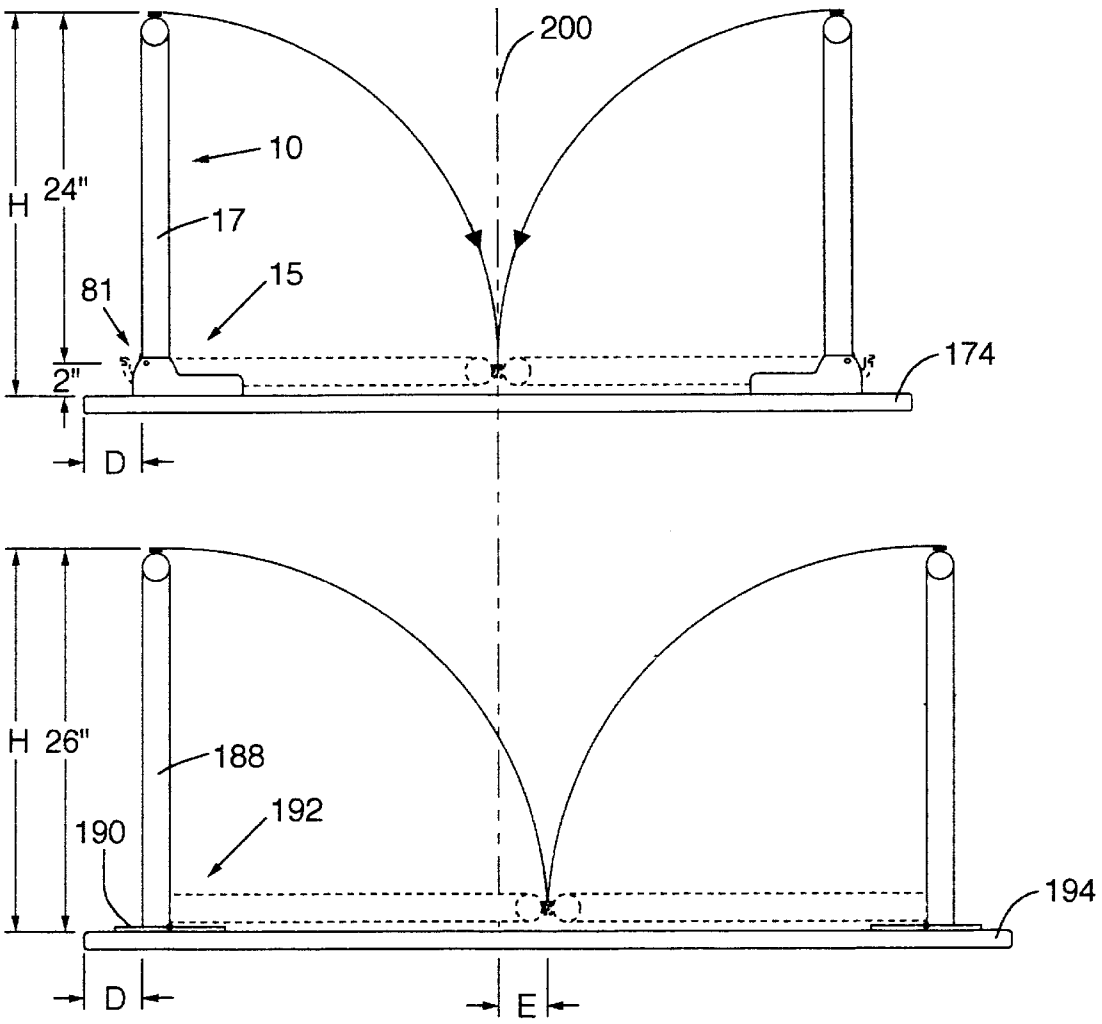
FIG. 11 illustrates a comparative example of the use of the present invention to provide for space saving and use in short length tables.

FIG. 11 illustrates an example of the use of the present invention with a table of minimum length as compared to other style or generic leg pivot or locking devices. The location of the pivot point 81 created by the dowel pin pivot 80 (and 82) away from the bottom surface of the table top is of great importance when incorporating the folding table leg system 10. The locking base 15 is positioned to locate the table leg 17 at a fixed distance D from the edge of the table top 174 as is a generic table leg 188 and a generic hinge 190 having a pivot 192 on a generic table top 194. Each table leg 17 and 188 provides for a common and equal height H between the lower table surface and the lower part of each table leg which sets on the floor. It can be seen that the length of table leg 17, incorporated in the present invention, is shorter than the length of generic table leg 188. For sake of discussion, assume that the pivot point 81 is 2 inches from the table undersurface and the length of the table leg 17 is 24 inches, thus providing support for the bottom of the table top 174 at 26 inches above the floor. Assume that pivot point 192 of the generic table top 194 is flush with the lower surface of the generic table top 194—both table legs 17 and 188 are then pivoted about their respective pivot points 81 and 192 toward the center of their respective table top lower surfaces. Table leg 17 swings about a 24-inch radius arc and meets the table tangent to reference line 200, while table leg 188 swings about a 26-inch radius arc to pass through the reference line 200. This distance, shown as extra distance E, is the required distance used by one generic table leg. Of course, the extra room required for two generic table legs would be twice the designated extra distance E or 2×E. Thus, it can be seen that the folding table leg system 10, the present invention, can be utilized for use in short length tables by virtue of the ability to require less space when folded for storage. Minimum distance between two extended table legs is achieved by utilization of the present invention.

ALTERNATIVE EMBODIMENT

Figure 12:
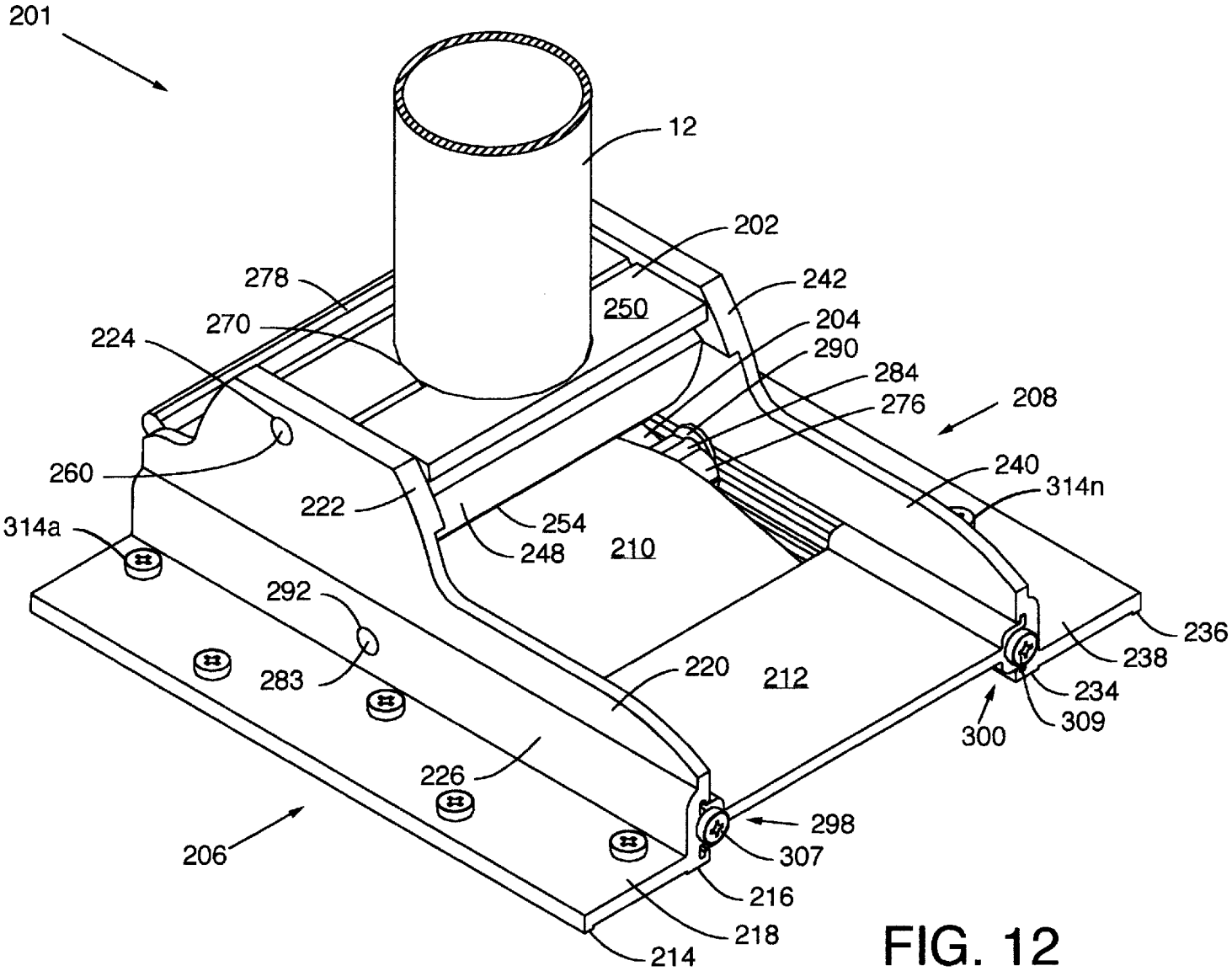
FIG. 12, an alternate embodiment, illustrates an isometric view of a locking base.

FIG. 12, an alternate embodiment, illustrates an isometric view of a locking base 201 for use in the folding table leg system 10, where all numerals correspond to those elements previously described. The main support tube 12, which is readily detachable, secures to and rotates with the locking base 201 to position a table leg.

Figure 13:
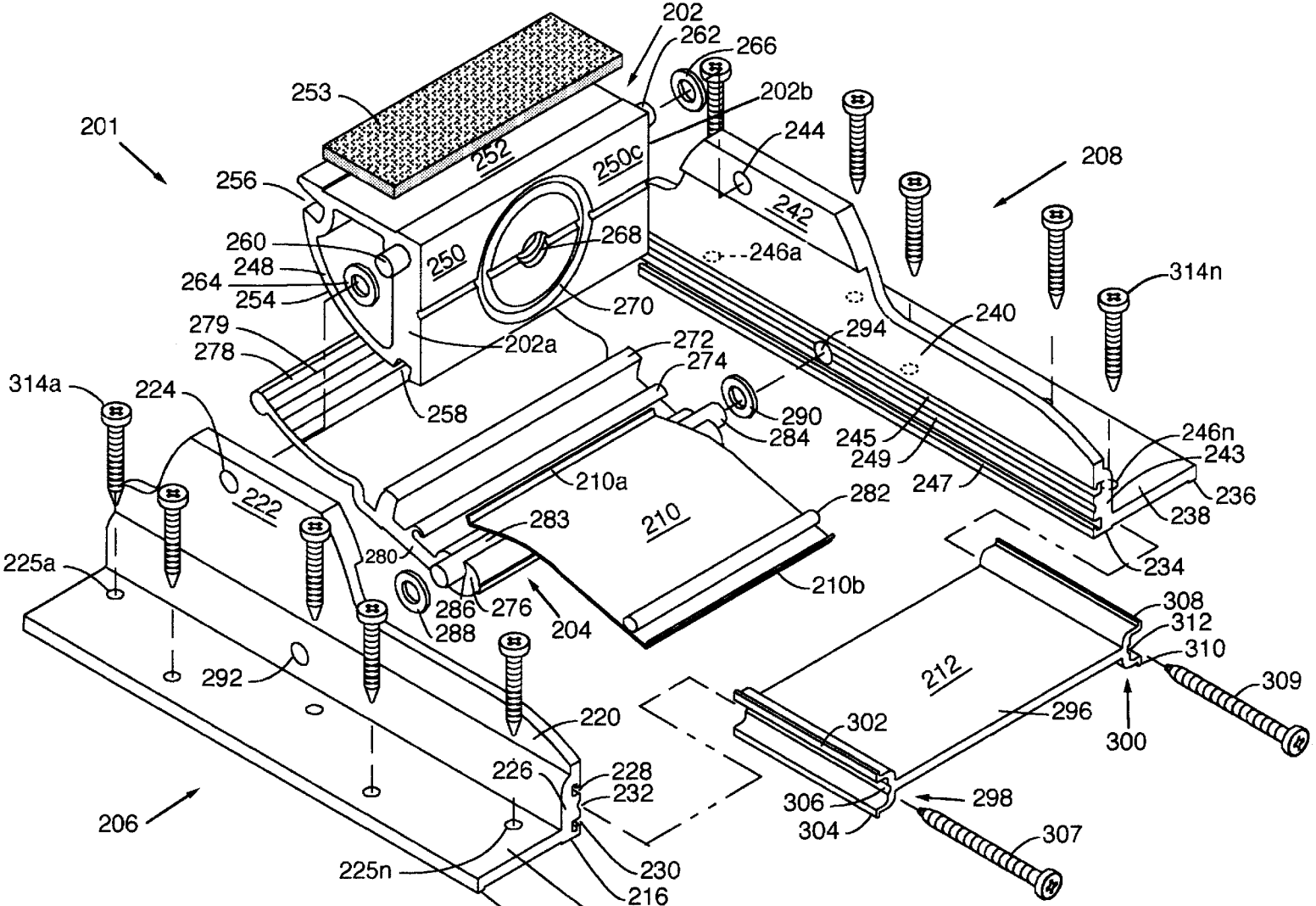
FIG. 13 illustrates an isometric exploded view of the locking base of FIG. 12.

The locking base 201 includes an extruded rotatable block member 202 and a configured latch member 204 which is positionable, also shown in FIG. 13, each pivotally supported between left and right mirror image-like angled support brackets 206 and 208, a wide formed spring member 210, and a cross member 212 captured and aligned between the vertical portions of the support brackets 206 and 208. The latch member 204 is spring loaded by the action of spring member 210 to engage either an uplock or downlock groove in the extruded rotatable block member 202, as later described in detail.

FIG. 13 illustrates an isometric exploded view of the locking base 201, where all numerals correspond to those elements previously described. The one-piece support bracket 206 includes longitudinal foot members 214 and 216, an interceding horizontal planar base member 218 aligned between the longitudinal foot members 214 and 216, and a vertical planar member 220 extending vertically from the horizontal planar member 218. The vertical planar member 220 includes an upper reinforced thicker area 222 having a horizontally aligned pivot hole 224. A plurality of recessed anchoring holes 225*a*–225*n* along the horizontal planar member 218 allow for the mounting of the support bracket 206 to the undersurface of a table by the use of appropriate fasteners. The vertical planar member 220 also includes a thicker lower area 226 having upper and lower angled slots 228 and 230, respectively, which accommodate members of the cross member 212. A radiused groove 232 is located on the thicker lower area 226 between the upper and lower angled slots 228 and 230.

The one-piece support bracket 208 is constructed in a similar fashion to include longitudinal foot members 234 and 236, an interceding horizontal planar member 238 aligned between the longitudinal foot members 234 and 236, and a vertical planar member 240 extending vertically from the horizontal planar member 238. The vertical planar member 240 includes an upper reinforced thicker area 242 having a horizontally aligned pivot hole 244. A plurality of recessed anchoring holes 246*a*–246*n* along the horizontal planar member 238 allow for the mounting of the support bracket 208 to the underside of a table by the use of appropriate fasteners. The vertical planar member 240 also includes a thicker lower area 243 having upper and lower angled slots 245 and 247, respectively, which accommodate members of the cross member 212. A radiused groove 249 is located on the thicker lower area 243 between the upper and lower angled slots 245 and 247.

Figure 14:
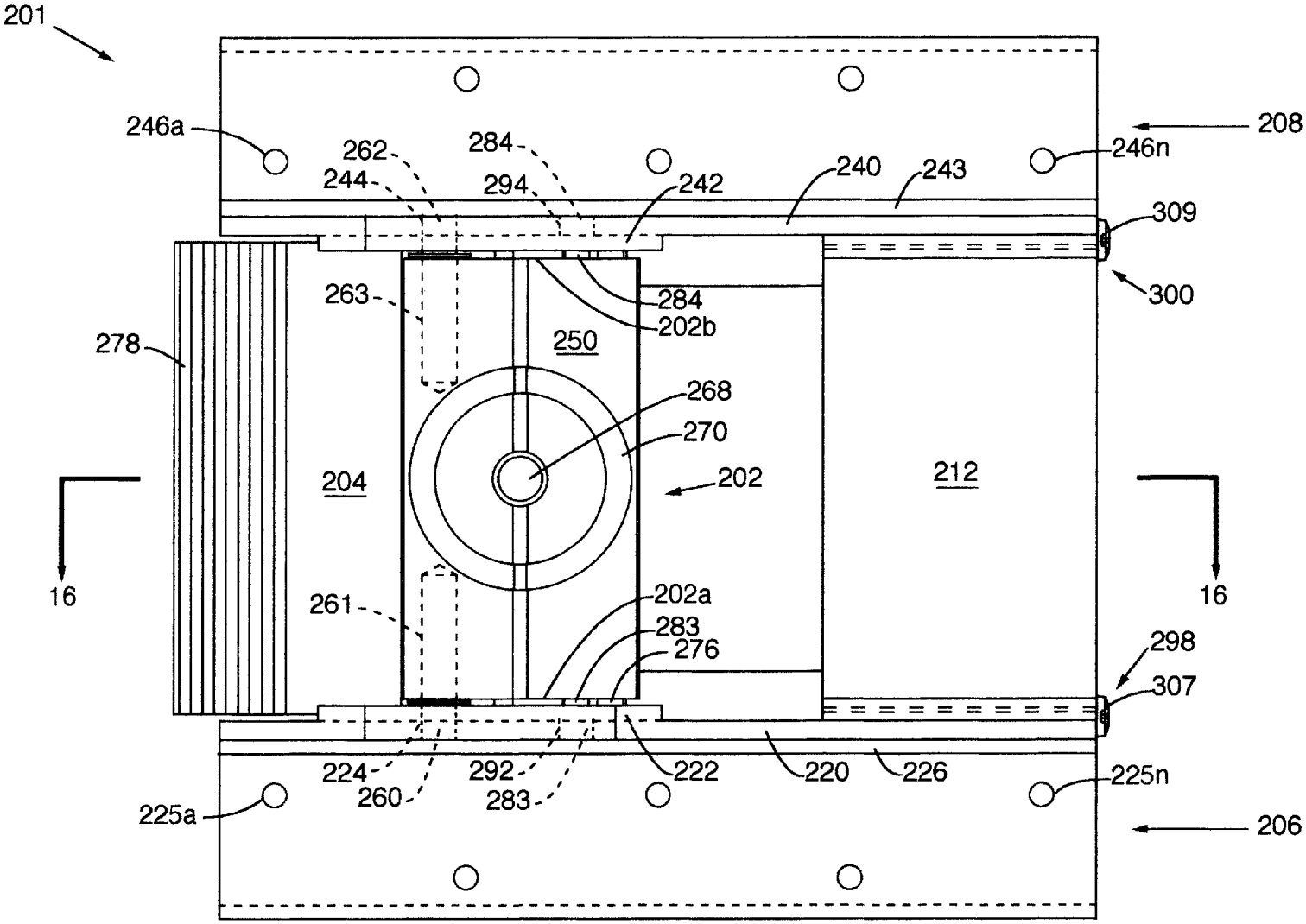
FIG. 14 illustrates a top view of the assembled locking base of FIG. 12.

The rotatable block member 202 is an extruded and machined member having an interrupted arc member 248 extending from one edge of a substantially rectangular solid block-like member 250 to intersect a substantially planar member 252, which extends in a perpendicular fashion from one edge of the block-like member 250. A stacking pad 253 secures to the planar member 252. The interrupted arc member 248 includes an arcuate surface 254 terminated near the edge of the arc surface by a horizontally aligned downlock groove 256 extending between sides 202*a* and 202*b* of the rotatable block member 202. The arcuate surface 254 is interrupted at the opposing end of the interrupted arc member 248 by a horizontally aligned uplock groove 258 extending between sides 202*a* and 202*b* of the rotatable block member 202. Dowel pin pivots 260 and 262, being the centers of rotation for the interrupted arc member 248, its arcuate surface 254, and the rotatable block member 202, frictionally engage holes 261 and 263 of the rotatable block member 202, as illustrated in FIG. 14, and extend outwardly and horizontally from the sides 202*a* and 202*b* of the rotatable block member 202 to accommodate washers 264 and 266 and horizontally aligned upper pivot holes 224 and 244 in the upper reinforced thicker areas 222 and 242 of the support brackets 206 and 208, respectively. A threaded hole 268 and an annular groove 270 align to the planar surface 250*c* in the block-like member 250 to mountingly accommodate and serve as a securement base for the threaded rod 92 and for the tubular edge 94 of the main support tube 12, as respectively shown in FIG. 2. A nut 96, illustrated in FIG. 1, gains access to the interior of the horizontal support tube 14 and the main support tube 12.

Figure 16:
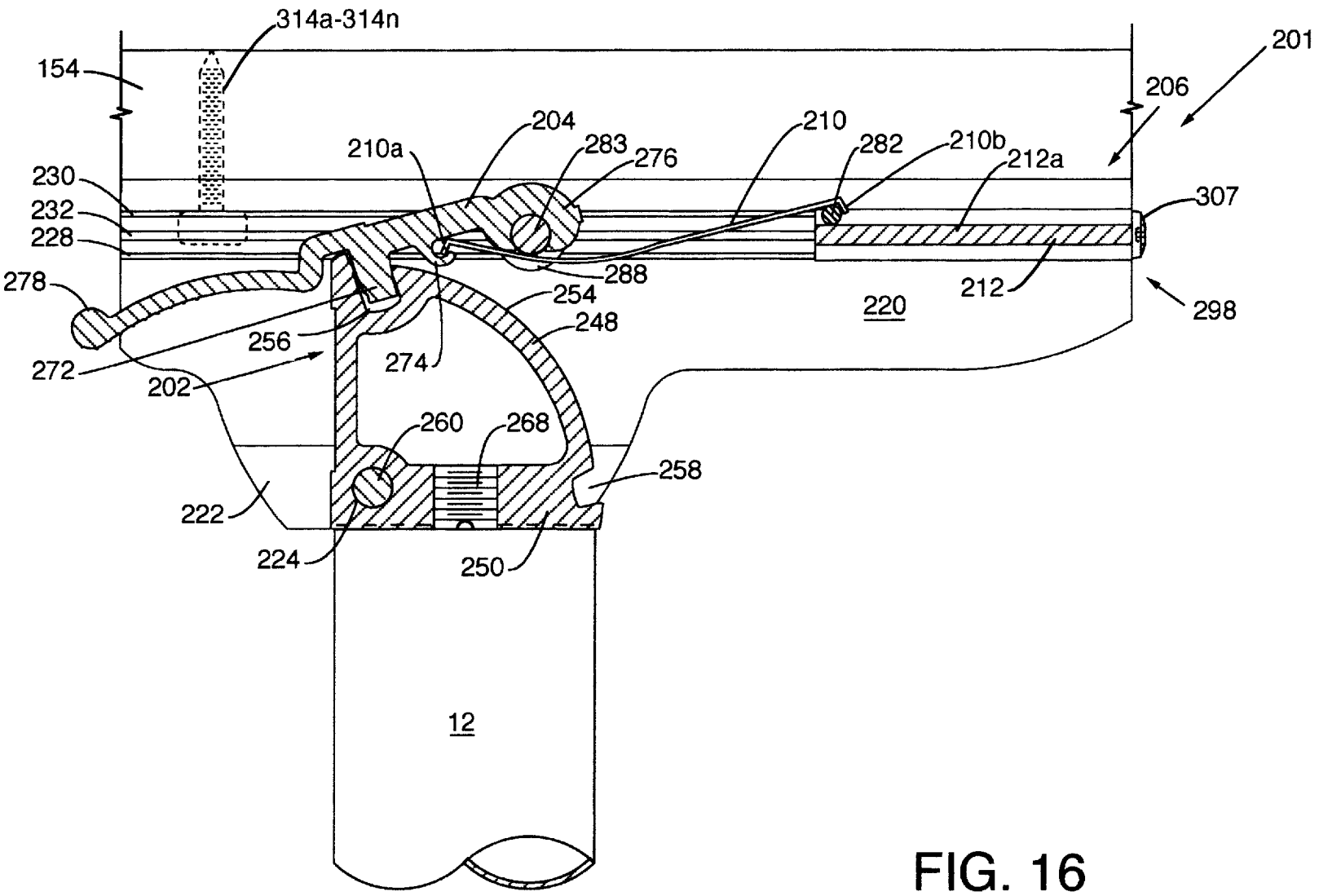
FIG. 16 illustrates an inverted cross sectional view along line 16—16 of FIG. 14 of the locking base with a main support tube in the down and locked position.

The positionable latch member 204 is extruded as a one-piece member which includes a locking pawl 272, a spring anchor 274, a pivot mount 276, and an actuating tab 278 having raised surfaces 279 for facilitating manual contact by interdigitation. The locking pawl 272 extends at an angle from a main body 280 to automatically engage either the downlock groove 256 or the uplock groove 258 subsequent to rotational movement of the rotatable block member 202 by manual pressure exerted on the main support tube 12. The spring anchor 274, having a hook-like profile, serves as a mount for one end of the spring member 210. Spring member 210 includes opposing angled edges 210*a* and 210*b*. The angled edge 210*a* of spring member 210 aligns in and engages the spring anchor 274. The opposing angled edge 210*b* captures a free floating dowel rod 282 between the planar portion 212*a* of the cross member 212 and the spring member 210, as illustrated in FIG. 16. Pivot pins 283 and 284 align in and frictionally engage arced profile area 286 of the pivot mount 276 and extend outwardly to rotatably align within spacer washers 288 and 290 and lower pivot holes 292 and 294 in the thicker lower areas 226 and 243 of the support brackets 206 and 208, respectively.

Figure 15:
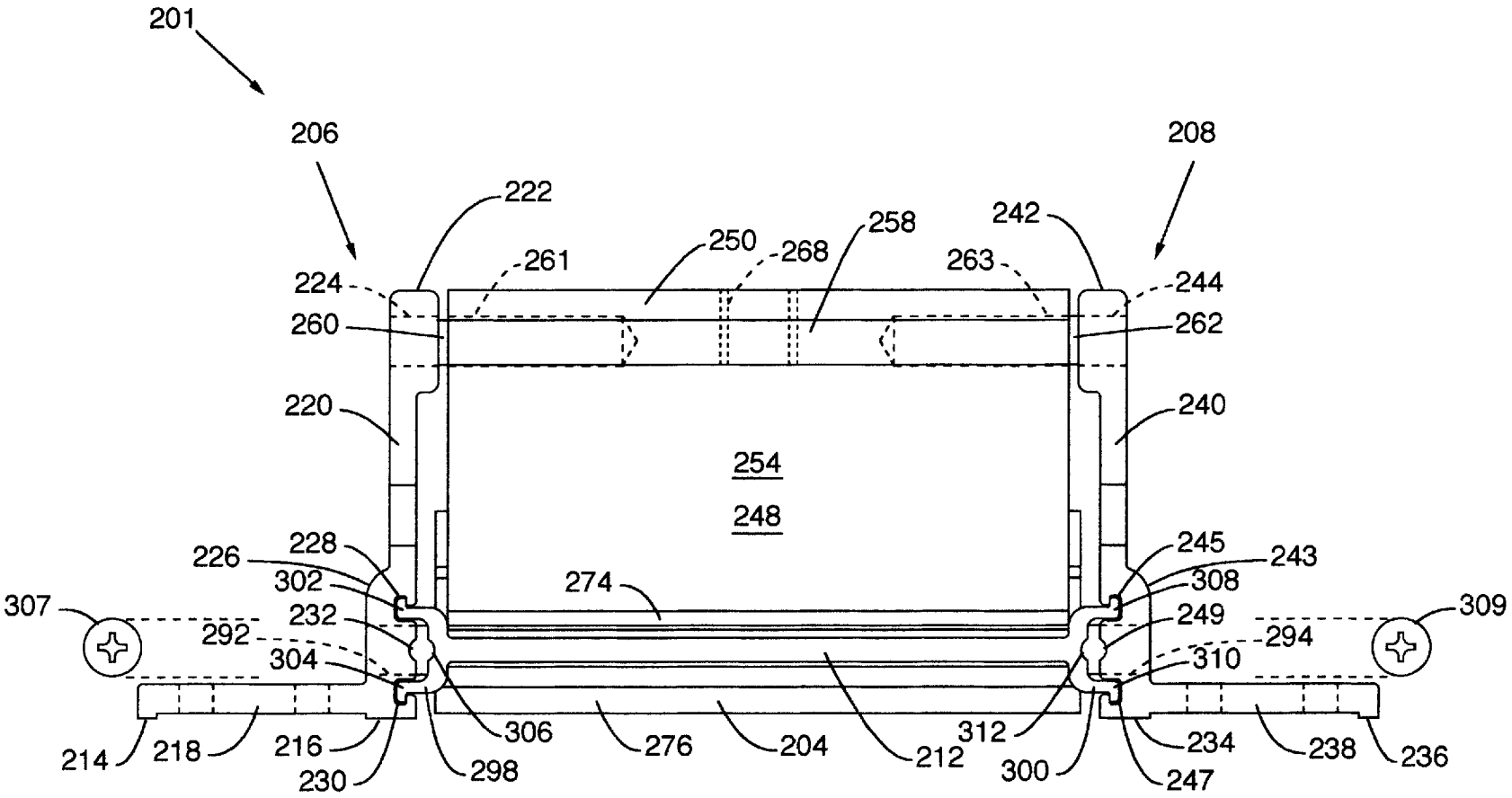
FIG. 15 illustrates a right end view of the locking base of FIG. 12.

Cross member 212, a one-piece metal extrusion, includes a central planar member 296 flanked by opposing U-shaped channel members 298 and 300. The ends of the U-shaped channel member 298 include opposing angled members 302 and 304 corresponding to the shape of the upper and lower angled slots 228 and 230 in the thicker lower area 226 of the support bracket 206 for mutual sliding engagement thereof. A radiused groove 306 is also included in parallel alignment with the opposing angled members 302 and 304. During fabrication, the angled members 302 and 304 of the channel member 298 engage the upper and lower angled slots 228 and 230 of the support bracket 206 to juxtapose radiused groove 232 of the support bracket 206 with the radiused groove 306 of the cross member 212, thus forming a segmented hole into which a screw 307 is screwingly engaged to secure the cross member 212 to the support bracket 206, as illustrated in FIGS. 14 and 15. U-shaped channel member 300 is constructed and utilized in a similar fashion as U-shaped channel member 298 to secure the cross member 212 to the support bracket 208 and includes opposing angled members 308 and 310 and a radiused groove 312. Screw 309 is utilized in the same manner and fashion as screw 307.

FIG. 14 illustrates a top view of the assembled locking base 201, where all numerals correspond to those elements previously described. Illustrated in particular is the horizontally aligned cross member 212 in frictional engagement with the support brackets 206 and 208. Screw 307 engages opposing radiused groove pair 232 and 306, illustrated in FIG. 13, and screw 309 engages opposing radiused groove pair 312 and 249, illustrated in FIG. 13, to secure the cross member 212 to the support brackets 206 and 208. Cross member 212 provides for lateral support and stability as well as for parallel alignment of the support brackets 206 and 208. During assembly, dowel pin pivots 260 and 262 are captured by pivot holes 224 and 244, respectively, and pivot pins 283 and 284 are captured by holes 292 and 294, respectively, to pivotally secure the rotatable block member 202 and the latch member 204 between support brackets 206 and 208 followed by insertion and securement of the cross member 212 between the support brackets 206 and 208, as previously described. Rotatable block member 202 serves as a mount for one main support tube 12 of FIG. 13. It is appreciated that a lengthened rotatable block member, and of course a lengthened cross member 212, as well as any other appropriate component members, can be utilized to provide for mounting of one or more support tubes across the breadth of a table top lower surface.

FIG. 15 illustrates a right end view of the locking base 201, where all numerals correspond to those elements previously described. Illustrated in particular is the alignment and engagement of the angled members 302 and 304 of channel member 298 in corresponding upper angled slot 228 and lower angled slot 230 of the support bracket 206, as well as the opposing alignment of radiused grooves 232 and 306 which screw 307 mutually engages. Also shown is the alignment and engagement of the angled members 308 and 310 of channel member 300 in corresponding upper angled slot 245 and lower angled slot 247 of the support bracket 208, as well as the opposing alignment of radiused grooves 312 and 249 which screw 309 mutually engages.

Figure 17:
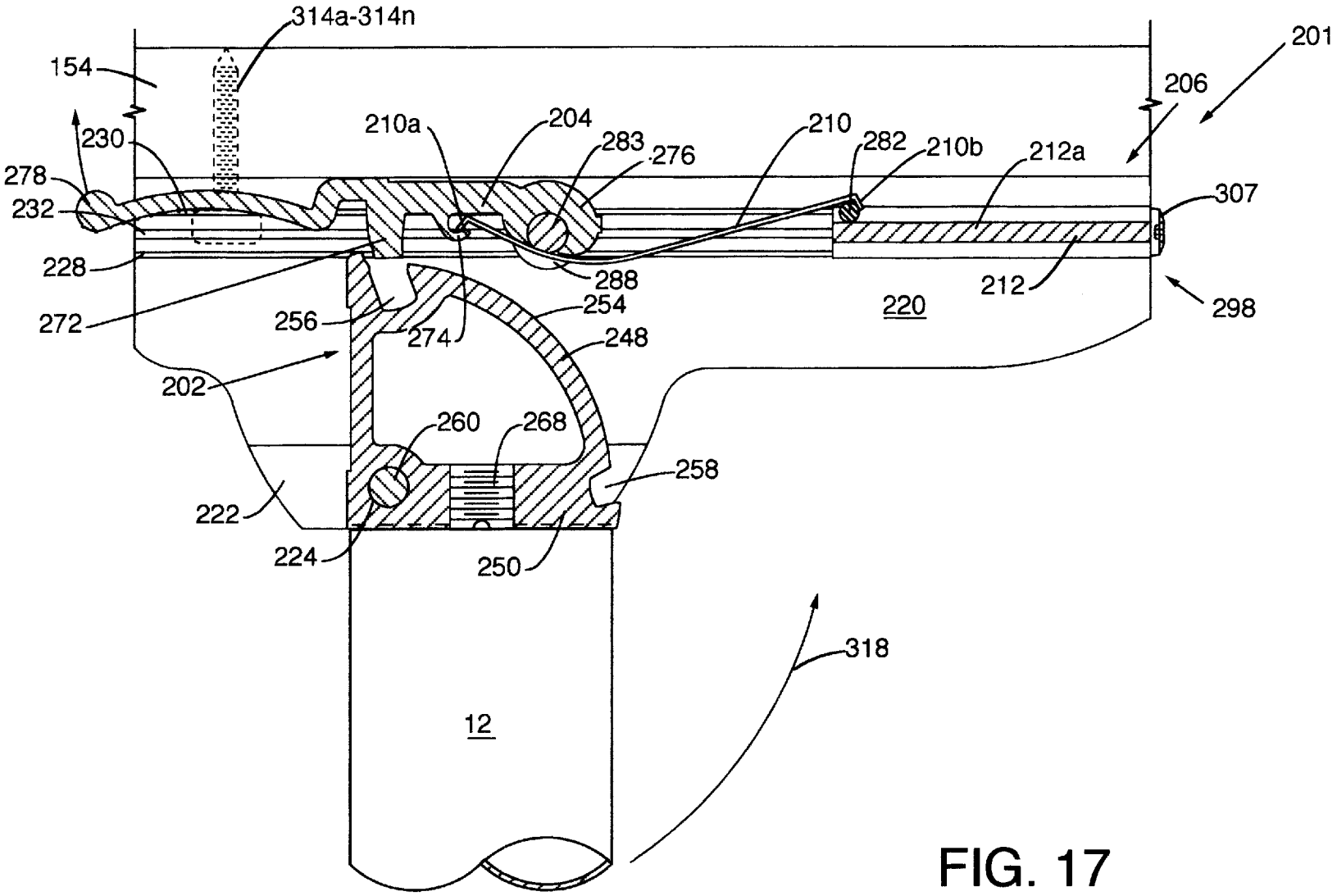
FIG. 17 illustrates the locking base of FIG. 16 and the disengagement of the locking pawl from the rotatable block member.
Figure 18:
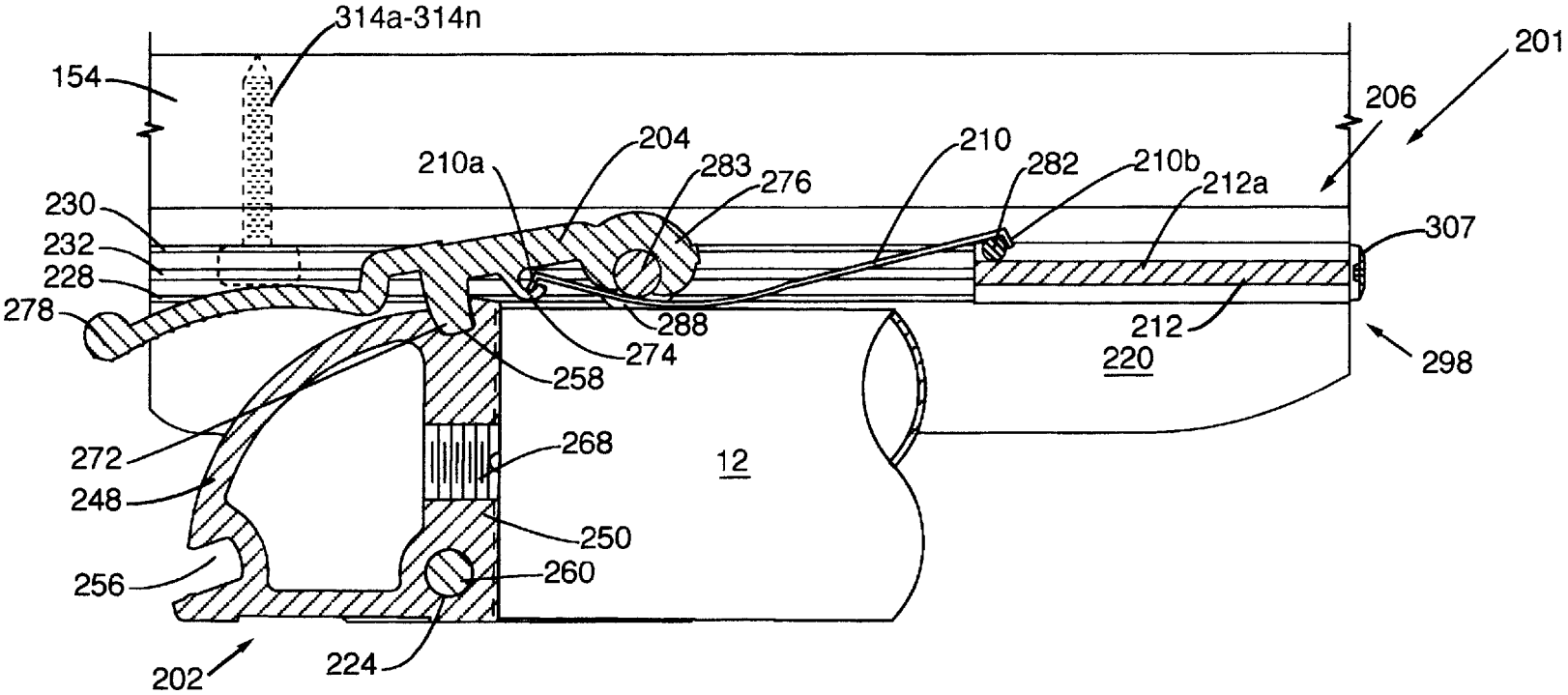
FIG. 18 illustrates the locking base of FIG. 16 with the main support tube in the up and locked position.

FIGS. 16, 17 and 18 best illustrate the mode of operation of the locking base 201.

FIG. 16 illustrates an inverted cross sectional view of the locking base 201 with the main support tube 12 rotated to the down and locked position as viewed along line 16-16 of FIG. 14, where all numerals correspond to those elements previously described. The locking base 201 secures by fasteners 314*a*–314*n* through support brackets 206 and 208 to a planar table member 154. Locking pawl 272, having angled or otherwise configured sides, is illustrated in wedge-like engagement with the downlock groove 256 in the rotatable block member 202 to maintain the rotatable block member 202 and thus the horizontal support tube 14 and the main support tube 12, of FIG. 1, in the down and locked position, as illustrated. The angled or otherwise configured sides of the locking pawl 272 are driven by the force of spring member 210 into wedge-like and/or tangential contact with opposing surfaces of the downlock groove 256, as illustrated in detail in FIG. 20.

Angled edge 210*a* of spring member 210 aligns and anchors in the spring anchor 274, on latch member 204, and angled edge 210*b* captures dowel rod 282 against the planar portion 212*a* of the cross member 212. The spring member 210 is poised and sprung about pivot pins 283 and 284. As the latch member 204 is actuated for disengagement of the locking pawl 272 from the downlock groove 256, the angled edge 210*b* is moved longitudinally, as is the spring member 210, with the free floating dowel rod 282, along and about the planar portion 212*a* of the cross member 212 as the spring member 210 is flexed. This sliding feature promotes smooth and efficient operation of the latch member 204 in conjunction with the spring member 210.

FIG. 17 illustrates the locking base 201 of FIG. 16 with the actuating tab 278 depressed upwardly to disengage the locking pawl 272 from the downlock groove 256 of the rotatable block member 202 so that the rotatable block member 202, main support tube 12 and attached horizontal support tube 14, of FIG. 1, can be pivoted about the dowel pin pivots 260 and 262. Manual actuation of actuating tab 278 frees the rotatable block member 202 for rotation about the dowel pin pivots 260 and 262. Upon release of the rotatable block member 202 from the locking pawl 272, the main support tube 12 and horizontal support tube 14, which form table leg 17, are swung as indicated by arrow 318 toward a position parallel to the planar table member 154, as shown in FIG. 18, to automatically engage the uplock groove 258 at the opposing end of the arcuate surface 254. During leg rotation, actuating tab 278 can be released. Spring pressure provided by spring member 210 causes the locking pawl 272 to slidingly traverse the arcuate surface 254 until automatic spring forced engagement of the locking pawl 272 with the uplock groove 258 is effected, as illustrated in FIG. 18. Automatic spring engagement of the locking pawl 272 with the downlock groove 256 is also provided for in the same manner.

FIG. 18 illustrates the locking base 201 of FIG. 16 having the rotatable block member 202 in the up and locked position, where all numerals correspond to those elements previously described. As previously described, actuating tab 278 was depressed allowing disengagement of the locking pawl 272 from the downlock groove 256 to allow positioning of the main support tube 12 of table leg 17 parallel to the planar table member 154, as illustrated. Spring member 210 forcibly positions the locking pawl 272 into wedge-like automatic forced engagement with the uplock groove 258 to lock the main support tube 12 of table leg 17 in the folded and stowed position. As previously described, the folded and stowed position of the main support tube 12 provides for leg stowage in very close proximity to the undersurface of the table. This close-in leg stowage offers a very low profile which is highly desirable when stacking of tables incorporating the folding table leg system. Placement of the dowel pin pivots 260 and 262 at a distance from, rather than closer to the table underside, is of great significance with respect to obtaining a low profile leg stowage. If, for instance, and as previously described, pivot points were placed at a point closer to the table undersurface or closer to the table center, stowage with a greater profile would be the likely outcome.

Figure 19:
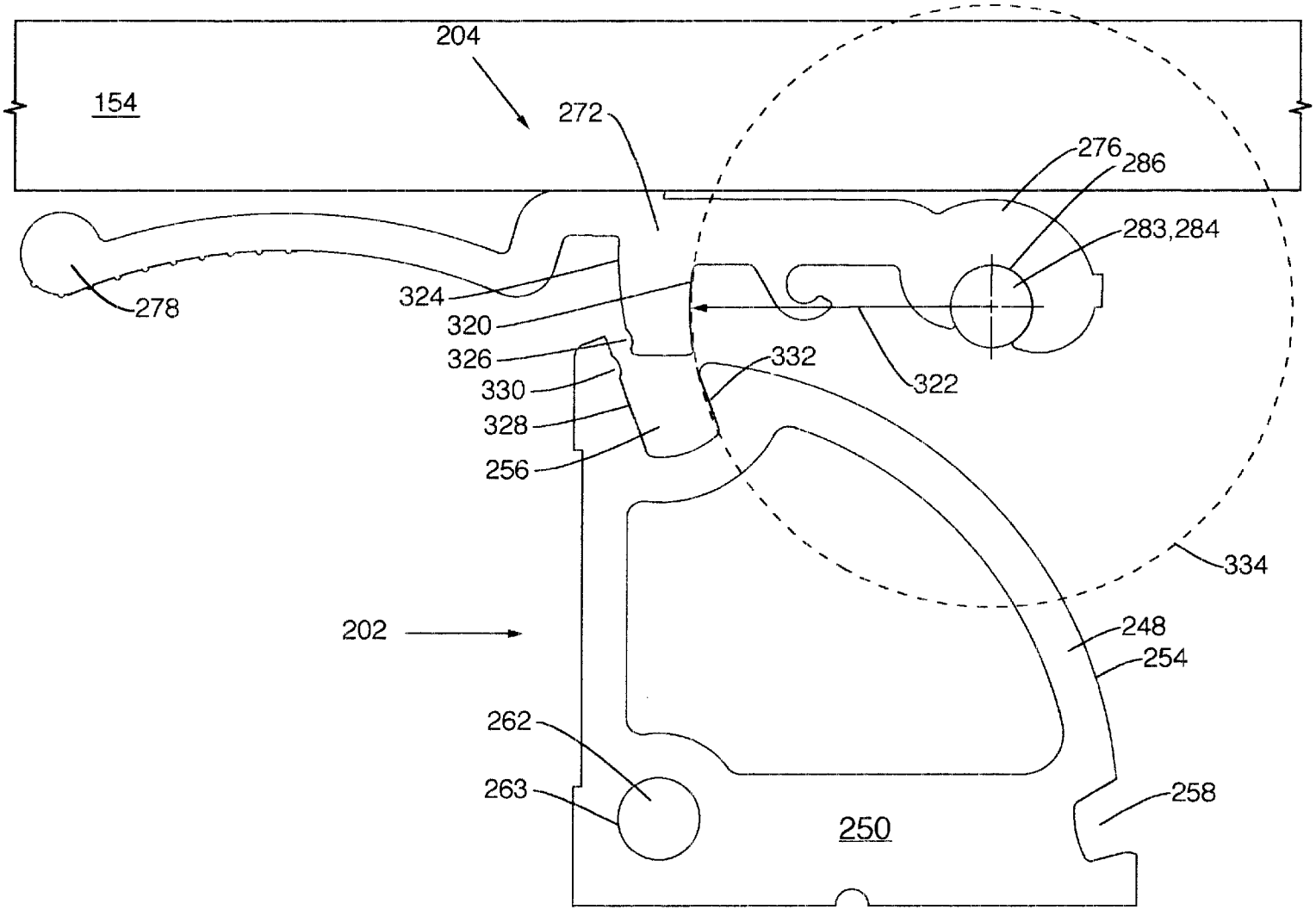
FIG. 19 illustrates a side view of surface members of the locking pawl and the downlock groove.

FIG. 19 illustrates a side view of latch member 204 aligned with, but disengaged from, the rotatable block member 202, where all numerals correspond to those elements previously described. The locking pawl 272 includes a curved surface 320 having a radius 322 centered on the arc profile area 286 and the pivot pins 283 and 284. Another curved and tapered surface 324, having an ever increasing clockwise radius, opposes curved surface 320, thus forming a one-sided wedge-like profile for the locking pawl 272. Also included, at the lower edge of curved surface 324, is a transverse groove 326. Rotatable block member 202 includes the downlock groove 256 having a surface 328 with a transverse arced lip 330. Opposing surface 328 is another surface 332 being tangent to the arc 334 described by radius 322.

Figure 20:
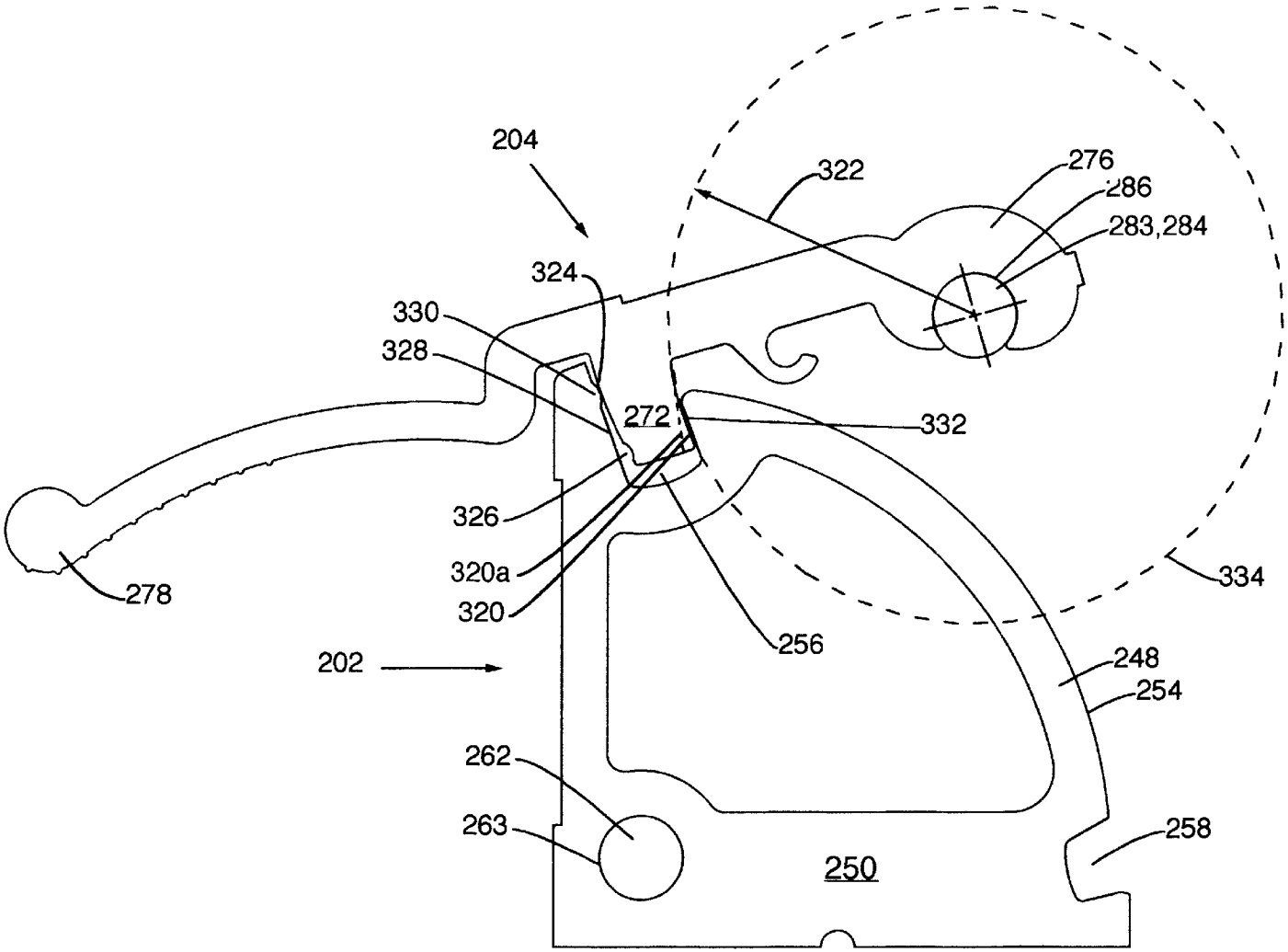
FIG. 20 illustrates a side view of surface members of the locking pawl engaging corresponding surface members of the downlock groove.

FIG. 20 illustrates the engagement of the locking pawl 272 of the latch member 204 with the downlock groove 256 of the rotatable block member 202, where all numerals correspond to those elements previously described. The locking pawl 272 includes surfaces 320 and 324 which are angularly displaced from each other to form a wedge. The tension of the spring member 210 forces the curved and tapered surface 324 and curved surface 320 of the locking pawl 272 into wedge-like and tangential engagement, the primary methods of locking, with extending arced lip 330 and surface 332, respectively. Constant force wedge-like engagement of the locking pawl 272 into the downlock groove 256 provides a primary method for secured rigidity of the table leg 17, without looseness or sloppiness, with respect to the planar table member 154 illustrated in FIG. 10. The forced impingement of curved surface 324 of the locking pawl 272, against the arced lip 330 positionally secures the rotatable block member 202 in the leg down and locked position and prevents any rotation of the rotatable block member 202 in a clockwise direction about dowel pin pivots 260 and 262. Component wear is accounted for in the design of the locking pawl 272 and the downlock groove 256 and adjacent areas. Should wear occur where the arced lip 330 contacts the curved surface 324, spring tension is available to drive the wedge-like locking pawl 272 deeper into the downlock groove 256 to ensure plumb and well secured alignment of the main support tube 12. The rotatable block member 202 maintains its plumb position and is not displaced as the locking pawl 272 is driven by spring pressure further into the downlock groove 256 as the tangential relationship of the locking pawl curved surface 320 and the downlock groove surface 332 is maintained about the radius 322 of arc 334.

A tangential locking feature also provides for primary secure locking of a table leg in addition to the spring tension applied to the latch member 204 and prevents counterclockwise rotation of the rotatable block member 202 about dowel pin pivots 260 and 262. Consider, for purposes of illustration, the removal or failure of spring member 210, and an angled surface 320*a* which does not conform to arc 334, but instead, cants inwardly, as illustrated, thus presenting an angled surface 320*a* to the upper portion of surface 332. Repeated or constant torsional or rotational side or end loads upon the main support tube 12 could cause rotation about dowel pin pivot 262 (and 260) in a counterclockwise fashion, whereby the upper portion of surface 332 of the rotatable block member 202, being forced against an angled surface 320*a*, causes cam effect to displace the locking pawl 272 upwardly and from engagement with the downlock groove 256. This action is eliminated in the present invention, as there is no angular differential at the juxtaposition of surface 332, of the downlock groove 256, and the curved surface 320 of the locking pawl 272, but these surface are, in essence, tangent to a common radius and parallel to each other. Torsional or rotational side or end loads are counteracted as a straight-on dead load, thereby eliminating any angular displacement of the rotatable block member 202.

Figure 21:
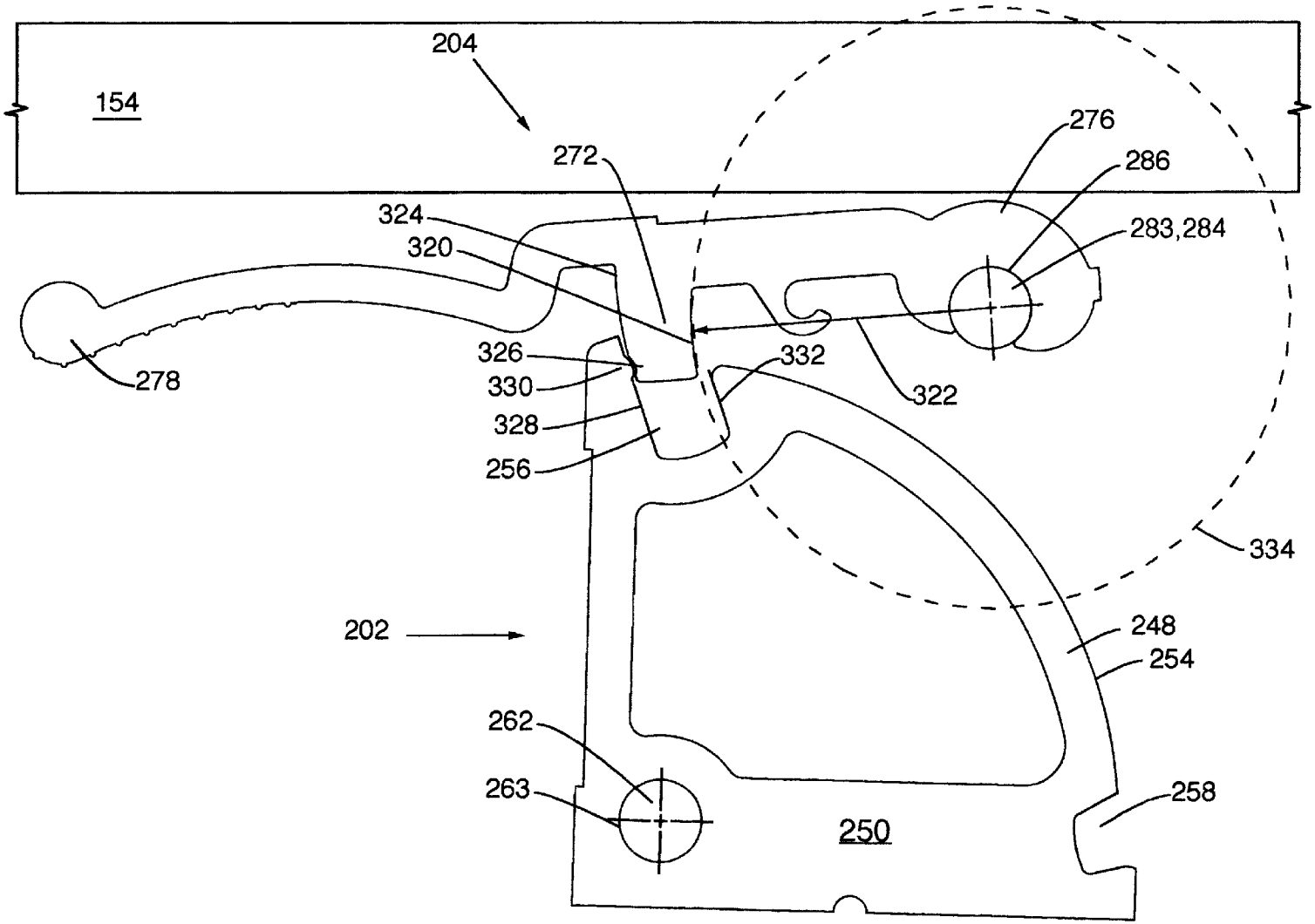
FIG. 21 illustrates a first secondary method of locking.

FIG. 21 illustrates a first secondary method of locking, where all numerals correspond to those elements previously described. Arced lip 330 provides a first secondary locking function where excess and/or massive torsional side or end loads are introduced to the table leg 17 to cause the rotatable block member 202 to rotate in a clockwise direction about dowel pin pivots 260 and 262, thereby forcing the locking pawl 272 from full engagement with the downlock groove 256. Horizontally aligned groove 326, at the lower portion of locking pawl curved surface 324, will catch and engage arced lip 330 if the locking pawl 272 is forced upwardly and outwardly from the downlock groove 256 by displacement of the table leg 17 and corresponding displacement of the rotatable block member 202. This engagement prevents collapse of the table leg 17, thereby holding the table leg 17 upright in an uncollapsed position with only a slight deviation from plumb vertical alignment.

Figure 22:
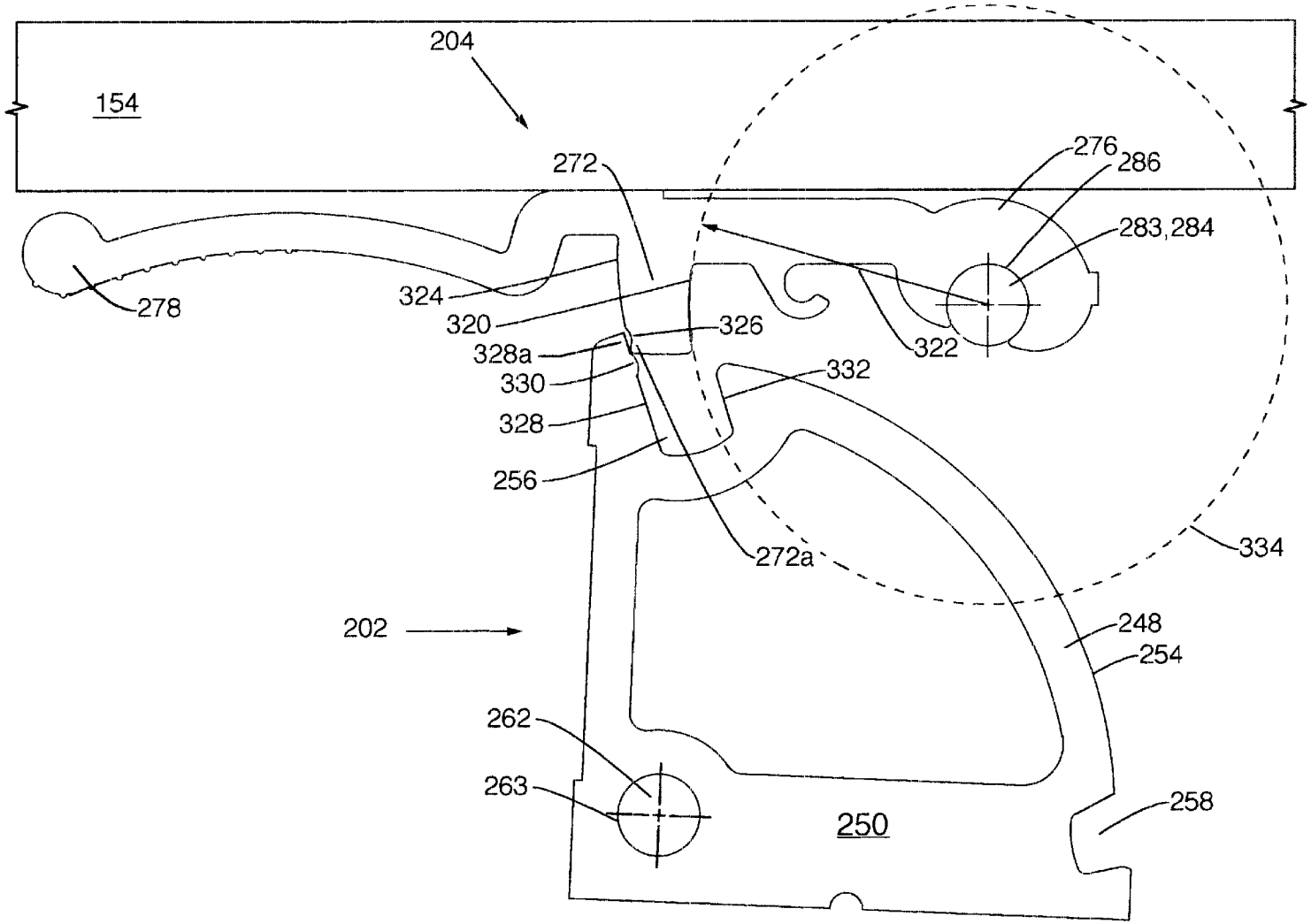
FIG. 22 illustrates another secondary method of locking.

FIG. 22 illustrates another secondary method of locking, where all numerals correspond to those elements previously described. As an additional secondary locking method, backup for the first secondary method described in FIG. 21, is provided should extremely violent massive torsional side or end loads be encountered by the table leg 17 and the locking base 201, whereby the rotatable block member 202 is rotated in a clockwise direction about dowel pin pivots 260 and 262 to force the locking pawl 272 from otherwise significant engagement with the downlock groove 256, past the point of possible mutual engagement of the horizontally aligned groove 326 and arced lip 330 where the latch member 204 is driven and forced with contact with the undersurface of the planar table member 154, as illustrated. It can be seen that further clockwise rotation of the rotatable block member 202 is prevented by impingement and interference of the upper surface position 328*a* of the downlock groove 256 with the lower portion 272*a* of the locking pawl 272.

FOUNDING TABLE LEG SYSTEM
PARTS LIST

| | |
|---|---|
| 10 | folding table leg system |
| 12 | main support tube |
| 14 | horizontal support tube |
| 15 | locking base |
| 16 | skid |
| 17 | table leg |
| 18 | skid |
| 20 | access hole |
| 22 | protective rubber member |
| 24 | rotatable block member |
| 26 | latch member |
| 28 | support bracket |
| 30 | support bracket |
| 32 | actuating lever |
| 32a | actuated position |
| 34 | actuating lever |
| 36 | end cap |
| 38 | end cap |
| 40 | vertical planar member |
| 42 | vertical planar member |
| 44 | horizontal planar member |
| 46 | vertical planar member |
| 48 | reinforced thicker area |
| 50 | pivot hole |
| 52a–n | holes |

-continued

FOUNDING TABLE LEG SYSTEM
PARTS LIST

| | |
|---|---|
| 54 | vertical planar member |
| 56 | vertical planar member |
| 58 | horizontal planar member |
| 60 | vertical planar member |
| 62 | reinforced thicker area |
| 64 | pivot hole |
| 66a–n | holes |
| 68 | block member |
| 68a–b | sides |
| 68c | planar surface |
| 70 | arcuate member |
| 72 | end member |
| 74 | arcuate surface |
| 76 | uplock groove |
| 78 | downlock groove |
| 80 | dowel pin point |
| 81 | pivot point |
| 82 | dowel pin pivot |
| 84 | washer |
| 86 | washer |
| 88 | threaded hole |
| 90 | annular groove |
| 92 | threaded rod |
| 94 | tubular edge |
| 96 | nut |
| 98 | planar member |
| 100 | pawl |
| 102 | planar member |
| 104 | spring member |
| 106 | spring member |
| 108a–n | fasteners |
| 110 | dowel pin pivot |
| 112 | dowel pin pivot |
| 114 | thick area |
| 116 | spacer washer |
| 118 | spacer washer |
| 120 | hole |
| 122 | hole |
| 124 | pin |
| 126 | pin |
| 128 | hole |
| 130 | hole |
| 132 | fluted engagement surface |
| 134 | fluted engagement surface |
| 136 | hole |
| 138 | hole |
| 140 | hole |
| 142 | hole |
| 144 | fluted engagement surface |
| 146 | fluted engagement surface |
| 148 | hole |
| 150 | hole |
| 152a–n | fasteners |
| 154 | planar table member |
| 156 | arrow |
| 158 | pawl surface |
| 160 | pawl surface |
| 162 | pawl center line |
| 164 | arced lip |
| 166 | arced lip |
| 168 | planar surface |
| 170 | groove |
| 172 | groove |
| 174 | table top |
| 180 | semi-circular hook member |
| 182 | semi-circular hook |

-continued

| FOUNDING TABLE LEG SYSTEM PARTS LIST | |
|---|---|
| | member |
| 184 | semi-circular latch member |
| 186 | semi-circular latch member |
| 188 | generic table leg |
| 190 | generic hinge |
| 192 | pivot |
| 194 | generic table top |
| 200 | reference line |
| 201 | locking base |
| 202 | rotatable block member |
| 202a–b | sides |
| 204 | latch member |
| 206 | support bracket |
| 208 | support bracket |
| 210 | spring member |
| 210a–b | angled edges |
| 212 | cross member |
| 212a | cross member planar portion |
| 214 | longitudinal foot member |
| 216 | longitudinal foot member |
| 218 | horizontal planar member |
| 220 | vertical planar member |
| 222 | reinforced thicker area |
| 224 | pivot hole |
| 225a–n | holes |
| 226 | thicker lower area |
| 228 | upper angled slot |
| 230 | lower angled slot |
| 232 | radiused groove |
| 234 | longitudinal foot member |
| 236 | longitudinal foot member |
| 238 | horizontal planar member |
| 240 | vertical planar member |
| 242 | reinforced thicker area |
| 243 | thicker lower area |
| 244 | pivot hole |
| 245 | upper angled slot |
| 246a–n | holes |
| 247 | lower angled slot |
| 248 | interrupted arc member |
| 249 | radiused groove |
| 250 | block-like member |
| 250c | planar surface |
| 252 | planar member |
| 253 | stacking pad |
| 254 | arcuate surface |
| 256 | downlock groove |
| 258 | uplock groove |
| 260 | dowel pin pivot |
| 261 | hole |
| 262 | dowel pin pivot |
| 263 | hole |
| 264 | washer |
| 266 | washer |
| 268 | threaded hole |
| 270 | annular groove |
| 272 | locking pawl |
| 272a | lower portion |
| 274 | spring anchor |
| 276 | pivot mount |
| 278 | actuating tab |
| 279 | raised surfaces |

-continued

| FOUNDING TABLE LEG SYSTEM PARTS LIST | |
|---|---|
| 280 | main body |
| 282 | dowel rod |
| 283 | pivot pin |
| 284 | pivot pin |
| 286 | arced profile area |
| 288 | washer |
| 290 | washer |
| 292 | hole |
| 294 | hole |
| 296 | central planar member |
| 298 | channel member |
| 300 | channel member |
| 302 | angled member |
| 304 | angled member |
| 306 | radiused groove |
| 307 | screw |
| 308 | angled member |
| 309 | screw |
| 310 | angled member |
| 312 | radiused groove |
| 314a–n | fasteners |
| 318 | arrow |
| 320 | curved surface |
| 320a | angled surface |
| 322 | radius |
| 324 | curved surface |
| 326 | groove |
| 328 | surface |
| 328a | surface |
| 330 | arced lip |
| 332 | surface |
| 334 | arc |

Various modifications can be made to the present invention without departing from the apparent scope hereof.

I claim:

1. A folding table leg system comprising:

a. a locking base with a cross member and two opposing vertical members with planar bases, and including opposing lower pivot holes and opposing upper pivot holes;

b. a geometrically configured latch member including a pivot pin at one end which engages into said lower pivot holes, a locking pawl in a mid-section, and an actuating tab at a second end;

c. a spring means connecting between said locking base and said latch member and includes an angled edge with a rod for engaging under said cross member; and, d. a rotatable block member having at least three corners and opposing dowel pin pivots at a first corner, a downlock groove and an uplock groove at second and third opposing corners, and a threaded hole on a planar surface for table leg attachment whereby said rotatable block member rotates so as to allow the table leg to be locked in a positive parallel to the table when the pawl engages the uplock groove or a table supporting position when the pawl engages the downlock groove.

2. The system of claim 1, wherein said latch member includes a spring anchor for receiving an angled end of said spring means.

3. The system of claim 1, wherein said latching member includes raised surfaces for interdigitation.

4. The system of claim 1, wherein said locking base includes a plurality of screw holes for screws engaging the underside of a table top.

* * * * *